US007948185B2

(12) United States Patent
Smith et al.

(10) Patent No.: US 7,948,185 B2
(45) Date of Patent: May 24, 2011

(54) INDUCTIVELY-DRIVEN PLASMA LIGHT SOURCE

(75) Inventors: Donald K. Smith, Belmont, MA (US); Stephen F. Horne, Somerville, MA (US); Matthew M. Besen, Andover, MA (US); Paul A. Blackborow, Cambridge, MA (US); Ron Collins, Londonderry, NH (US)

(73) Assignee: Energetiq Technology Inc., Woburn, MA (US)

( * ) Notice: Subject to any disclaimer, the term of this patent is extended or adjusted under 35 U.S.C. 154(b) by 1064 days.

(21) Appl. No.: 11/653,065

(22) Filed: Jan. 12, 2007

(65) Prior Publication Data

US 2007/0210717 A1 Sep. 13, 2007

Related U.S. Application Data

(63) Continuation-in-part of application No. 11/176,015, filed on Jul. 7, 2005, now abandoned, which is a continuation-in-part of application No. 10/888,434, filed on Jul. 9, 2004, now Pat. No. 7,183,717, and a continuation-in-part of application No. 10/888,795, filed on Jul. 9, 2004, now Pat. No. 7,307,375, and a continuation-in-part of application No. 10/888,955, filed on Jul. 9, 2004, now Pat. No. 7,199,384.

(51) Int. Cl.
*H05B 31/26* (2006.01)

(52) U.S. Cl. ..... 315/111.21; 315/111.91

(58) Field of Classification Search ..... 315/111.01, 315/111.21, 111.41, 111.71, 111.91; 313/153, 313/161; 250/504 R, 493.1, 53
See application file for complete search history.

(56) References Cited

U.S. PATENT DOCUMENTS

| | | | | |
|---|---|---|---|---|
| 3,500,118 | A | 3/1970 | Anderson | |
| 3,509,490 | A | 4/1970 | Zarowin | |
| 3,535,653 | A | 10/1970 | Zarowin | |
| 4,005,330 | A | 1/1977 | Glascock et al. | |
| 4,017,764 | A | 4/1977 | Anderson | |
| 4,042,848 | A | 8/1977 | Lee | 313/231.6 |
| 4,240,010 | A | 12/1980 | Buhrer | |
| 4,253,047 | A | 2/1981 | Walker et al. | |

(Continued)

FOREIGN PATENT DOCUMENTS

GB 1 555 097 11/1979

(Continued)

OTHER PUBLICATIONS

Atwood, EUV Source Candidates for Clean, Collectable 13-14 nm Wavelength Radiation, class illustrations for Chapter 6 of Soft X-rays and Extreme Ultraviolet Radiation: Principles and Applications, *Course AST210*, UC Berkeley, (Jan. 2004).

(Continued)

*Primary Examiner* — Jacob Y Choi
*Assistant Examiner* — Jimmy T Vu
(74) *Attorney, Agent, or Firm* — Proskauer Rose LLP

(57) ABSTRACT

An apparatus for producing light includes a chamber that has a plasma discharge region and that contains an ionizable medium. The apparatus also includes a magnetic core that surrounds a portion of the plasma discharge region. The apparatus also includes a pulse power system for providing at least one pulse of energy to the magnetic core for delivering power to a plasma formed in the plasma discharge region that forms a secondary circuit of a transformer. The plasma has a localized high intensity zone.

41 Claims, 27 Drawing Sheets

U.S. PATENT DOCUMENTS

| | | | | |
|---|---|---|---|---|
| 4,376,912 | A | 3/1983 | Jernakoff | |
| 4,415,838 | A | 11/1983 | Houkes | |
| 4,945,562 | A | 7/1990 | Staub | |
| 5,041,760 | A | 8/1991 | Koloc | |
| 5,539,283 | A | 7/1996 | Piejak et al. | |
| 5,619,103 | A * | 4/1997 | Tobin et al. | 315/111.21 |
| 5,821,705 | A | 10/1998 | Caporaso et al. | 315/507 |
| 5,982,100 | A * | 11/1999 | Ghanbari | 315/111.21 |
| 6,150,628 | A | 11/2000 | Smith et al. | 219/121.54 |
| 6,359,969 | B1 | 3/2002 | Shmaenok | 378/156 |
| 6,380,680 | B1 | 4/2002 | Troxler | |
| 6,388,226 | B1 | 5/2002 | Smith et al. | 219/121.57 |
| 6,418,874 | B1 | 7/2002 | Cox et al. | |
| 6,421,421 | B1 | 7/2002 | McGeoch | |
| 6,486,431 | B1 | 11/2002 | Smith et al. | 219/121.57 |
| 6,494,998 | B1 * | 12/2002 | Brcka | 204/192.12 |
| 6,541,786 | B1 | 4/2003 | Partlo et al. | 250/504 R |
| 6,552,296 | B2 | 4/2003 | Smith et al. | 219/121.43 |
| 6,559,408 | B2 | 5/2003 | Smith et al. | 219/121.57 |
| 6,566,668 | B2 | 5/2003 | Rauch et al. | 250/504 R |
| 6,678,037 | B2 | 1/2004 | Van Elp et al. | 355/67 |
| 6,804,327 | B2 | 10/2004 | Schriever et al. | 378/119 |
| 6,815,700 | B2 | 11/2004 | Melnychuk et al. | 250/504 R |
| 6,826,451 | B2 | 11/2004 | del Puerto et al. | 700/245 |
| 6,838,684 | B2 | 1/2005 | Bakker et al. | 250/492.2 |
| 6,872,909 | B2 | 3/2005 | Holber et al. | |
| 6,881,971 | B2 | 4/2005 | Ahmad | 250/504 R |
| 6,894,298 | B2 | 5/2005 | Ahmad et al. | 250/504 R |
| 7,107,929 | B2 * | 9/2006 | Horsky et al. | 118/723 CB |
| 7,307,375 | B2 | 12/2007 | Smith et al. | 313/31 |
| 2002/0101167 | A1 | 8/2002 | Shan et al. | 315/111.11 |
| 2002/0154279 | A1 | 10/2002 | Koster et al. | 335/30 |
| 2002/0163313 | A1 | 11/2002 | Ness et al. | 315/111.01 |
| 2002/0167282 | A1 | 11/2002 | Kirkpatrick et al. | 315/248 |
| 2002/0186814 | A1 | 12/2002 | McGeoch | 378/119 |
| 2002/0186815 | A1 | 12/2002 | McGeoch | |
| 2003/0006383 | A1 | 1/2003 | Melnychuk et al. | 250/504 |
| 2003/0053588 | A1 * | 3/2003 | Kondo et al. | 378/34 |
| 2003/0057877 | A1 | 3/2003 | Kurachi et al. | 315/248 |
| 2003/0068012 | A1 | 4/2003 | Ahmad et al. | 378/119 |
| 2003/0222557 | A1 | 12/2003 | Kurachi et al. | 313/46 |
| 2004/0036423 | A1 | 2/2004 | Lezcano et al. | 315/248 |
| 2004/0108473 | A1 | 6/2004 | Melnychuk et al. | 250/504 |

FOREIGN PATENT DOCUMENTS

| | | | |
|---|---|---|---|
| JP | 56125882 | | 2/1981 |
| JP | 58-152352 | | 9/1983 |
| JP | 61-163547 | | 7/1986 |
| JP | S61-106007 | | 7/1986 |
| JP | 63-048733 | | 3/1988 |
| JP | 02-256233 | | 10/1990 |
| JP | 02-267896 | | 11/1990 |
| JP | 2003-218025 | | 7/2003 |
| JP | 2004-128105 | | 4/2004 |
| RU | 2022917 | C1 | 11/1994 |
| WO | WO 90/13136 | A | 11/1990 |
| WO | WO 99/00823 | | 1/1999 |
| WO | 02/096514 | | 12/2002 |
| WO | 03/087867 | | 10/2003 |

OTHER PUBLICATIONS

Kandlikar, "Heat Transfer Characteristics in Partial Boiling, Fully Developed Boiling, and Significant Void Flow Regions of Subcooled Flow Boiling," *Journal of Heat Transfer* (Feb. 2, 1998) pp. 1-7.

Kaneda et al., "Plasma parameters in noble-gas narrow-tube and capillary-tube discharge, positive column plasma," *J. Phys. D: Appl. Phys*, vol. 23 (1990) pp. 500-503.

Kapteyn, "Compact Coherent EUV Sources", presented at Workshop for users of the Proposed Argonne Linear Free-electron Laser Facility (ALFF), *Argonne National Laboratory*, Argonne, IL (Oct. 30-31, 2003).

Lebert et al., "A gas discharged based radiation source for EUV-lithography," *Microelectronic Engineering*, vol. 46 (1999) pp. 449-452.

Liberman et al., *Physics of High-Density Z-Pinch Plasmas*, Springer-Verlag, New York, (1999) pp. 1-277.

McGeoch, "Progress on the Astron EUV Source," presented at the International SEMATECH 2001 Next Generation Lithography Workshop (Aug. 29, 2001) pp. 1-9.

Mohanty et al., "A novel fast capillary discharge system emitting intense EUV radiation," *Microelectronic Engineering*, vol. 65 (2003) pp. 47-59.

O'Sullivan et al., "Spectroscopy of a 13.5 nm Laser Plasma Source" *International SEMATECH EUVL Source Workshop* (Oct. 2002) pp. 1-31.

Pouvesle et al., "Discharge-based sources of XUV-X radiations: development and applications," *Plasma Sources Science and Technology* vol. 12 (2003) pp. S43-S50.

Teramoto et al., "High repetition rate MPC generator-driven capillary Z-pinch EUV source," SPIE 29$^{th}$ Annual International Symposium on Microlithography, Santa Clara, CA (Feb. 22-27, 2004) pp. 1-23.

Teramoto et al., "Radiation Characteristics of a Capillary Z-Pinch EUV Source," 2$^{nd}$ International EUVL Symposium, Antwerp, Belgium (Sep. 30-Oct. 2, 2003) pp. 1-18.

Wheeler et al., "The high-power constricted plasma discharge col. I. Theoretical analysis," *J. Phys. D: Appl. Phys*, vol. 3 (1970) pp. 1374-1380.

Wheeler, "The high-power constricted plasma discharge col. II. Experimental investigation," *J. Phys. D: Appl. Phys*, vol. 4 (1971) pp. 400-408.

Invitation to Pay Additional Fees (Form PCT/ISA/206) for PCT/US2005/024095 (Dec. 21, 2005).

Inasaka et al., "Critical heat flux multiplier of subcooled flow boiling for non-uniform heating conditions in a swirl tube," *Fusion Engineering and Design*, vol. 28, 1995, pp. 53-58.

Hassanein et al., "Candidate Plasma-Facing Materials for EUV Lithography Source Components," *Emerging Lithographic Technologies VII, Proceedings of the SPIE*, vol. 5037, 2003, pp. 358-369.

McGeoch et al., "Star Pinch Scalable EUV Source," *Emerging Lithographic Technologies VII, Proceedings of the SPIE*, vol. 5037, 2003, pp. 141-146.

Pankert et al. "Integrating Philips' extreme UV source in the alpha-tools", Proceedings of SPIE, vol. 5751, pp. 260-271 (2005).

Shao et al., "Emission Properties of Electrodeless Argon Gas Discharge in VUV Region," Japanese Journal of Applied Physics, vol. 26, No. 6, Jun. 1987, pp. 924-926.

Wittry, "Novel "heat-pipe" rotating anode for x-ray lithography," J. Vac. Sci. Technol., 16(6), Nov./Dec. 1979, pp. 1946-1948.

Yu et al., "Wide area windowless disk plasma lamp of uniform intensity for use in microelectronic film processing," J. Vac. Sci. Technol. B 9(2), Mar./Apr. 1991, pp. 348-352.

Teramoto et al., "Xe- and Sn-fueled Z-pinch EUV source development aiming at HVM," 4$^{th}$ EUVL Symposium, San Diego CA, USA, Nov. 7-9, 2005, pp. 1-19.

Horiike, "Asia Pacific Regional Update," 2005 EUVL Symposium, San Diego CA, U.S.A., EUVA/ASET (Japan) (National Institute for Materials Science).

Kogan et al., "Methods of Experimental Investigation and Measurement," Institute of Thermophysics, Novosibirsk, Translated from Teplofizika Vysokikh Temperatur, vol. 31, No. 1, pp. 105-110, Jan./Feb. 1993, pp. 129-135.

Shao et al., "Vacuum Ultraviolet Light Source Using Electrodeless Discharge," Japanese Journal of Applied Physics, vol. 25, No. 1, Jan. 1986, pp. 64-67.

Cremers et al., "Evaluation of the continuous optical discharge for spectrochemical analysis," Spectrochimica Acta, vol. 40B, No. 4, 1985, pp. 665-679.

Bell, W.E., "Ring Discharge Excitation of Gas Ion Lasers," Applied Physics Letters, vol. 7, No. 7, Oct. 1, 1965, pp. 190-191.

Goldsborough, J.P., et al., "RF Induction Excitation of CW Visible Laser Transitions in Ionized Gases," Applied Physics Letters, vol. 8, No. 6, Mar. 15, 1966, pp. 137-139.

Jun. 18, 2010 European Search Report for EP 10 15 5223.

* cited by examiner

INDUCTIVELY-DRIVEN PLASMA LIGHT SOURCE

RELATED APPLICATIONS

This application is a continuation-in-part of U.S. Ser. No. 11/176,015, filed on Jul. 7, 2005, which is a continuation-in-part of U.S. Ser. Nos. 10/888,434, 10/888,795 and 10/888,955, all filed on Jul. 9, 2004. This application claims priority to and incorporates by reference in their entirety U.S. Ser. Nos. 11/176,015, 10/888,434, 10/888,795 and 10/888,955.

FIELD OF THE INVENTION

The invention relates to methods and apparatus for generating a plasma, and more particularly, to methods and apparatus for providing an inductively-driven plasma light source.

BACKGROUND OF THE INVENTION

Plasma discharges can be used in a variety of applications. For example, a plasma discharge can be used to excite gases to produce activated gases containing ions, free radicals, atoms and molecules. Plasma discharges also can be used to produce electromagnetic radiation (e.g., light). The electromagnetic radiation produced as a result of a plasma discharge can itself be used in a variety of applications. For example, electromagnetic radiation produced by a plasma discharge can be a source of illumination in a lithography system used in the fabrication of semiconductor wafers. Electromagnetic radiation produced by a plasma discharge can alternatively be used as the source of illumination in microscopy systems, for example, a soft X-ray microscopy system. The parameters (e.g., wavelength and power level) of the light vary widely depending upon the application.

The present state of the art in (e.g., extreme ultraviolet and x-ray) plasma light sources consists of or features plasmas generated by bombarding target materials with high energy laser beams, electrons or other particles or by electrical discharge between electrodes. A large amount of energy is used to generate and project the laser beams, electrons or other particles toward the target materials. Power sources must generate voltages large enough to create electrical discharges between conductive electrodes to produce very high temperature, high density plasmas in a working gas. As a result, however, the plasma light sources generate undesirable particle emissions from the electrodes.

It is therefore a principal object of this invention to provide a plasma source. Another object of the invention is to provide a plasma source that produces minimal undesirable emissions (e.g., particles, infrared light, and visible light). Another object of the invention is to provide a high energy light source.

Another object of the invention is to provide an improved lithography system for semiconductor fabrication. Yet another object of the invention is to provide an improved microscopy system.

SUMMARY OF THE INVENTION

The present invention features a plasma source for generating electromagnetic radiation.

The invention, in one aspect, features a light source. The light source includes a chamber having a plasma discharge region and containing an ionizable medium. The light source also includes a magnetic core that surrounds a portion of the plasma discharge region. The light source also includes a pulse power system for providing at least one pulse of energy to the magnetic core for delivering power to a plasma formed in the plasma discharge region. The plasma has a localized high intensity zone.

The plasma can substantially vary in current density along a path of current flow in the plasma. The zone can be a point source of high intensity light. The zone can be a region where the plasma is pinched to form a neck. The plasma can be a non-uniform plasma. The zone can be created by, for example, gas pressure, an output of the power system, or current flow in the plasma.

The light source can include a feature in the chamber for producing a non-uniformity in the plasma. The feature can be configured to substantially localize an emission of light by the plasma. The feature can be removable or, alternatively, be permanent. The feature can be located remotely relative to the magnetic core. In one embodiment the feature can be a gas inlet for producing a region of higher pressure for producing the zone. In another embodiment the feature can be an insert located in the plasma discharge region. The feature can include a gas inlet. In some embodiments of the invention the feature or insert can include cooling capability for cooling the insert or other portions of the light source. In certain embodiments the cooling capability involves pressurized subcooled flow boiling. The light source also can include a rotating disk that is capable of alternately uncovering the plasma discharge region during operation of the light source. At least one aperture in the disk can be the feature that creates the localized high intensity zone. The rotating disk can include a hollow region for carrying coolant. A thin gas layer can conduct heat from the disk to a cooled surface.

In some embodiments the pulse of energy provided to the magnetic core can form the plasma. Each pulse of energy can possess different characteristics. Each pulse of energy can be provided at a frequency of between about 100 pulses per second and about 15,000 pulses per second. Each pulse of energy can be provided for a duration of time between about 10 ns and about 10 μs. The at least one pulse of energy can be a plurality of pulses.

In yet another embodiment of the invention the pulse power system can include an energy storage device, for example, at least one capacitor and/or a second magnetic core. A second magnetic core can discharge each pulse of energy to the first magnetic core to deliver power to the plasma. The pulse power system can include a magnetic pulse-compression generator, a magnetic switch for selectively delivering each pulse of energy to the magnetic core, and/or a saturable inductor. The magnetic core of the light source can be configured to produce at least essentially a Z-pinch in a channel region located in the chamber or, alternatively, at least a capillary discharge in a channel region in the chamber. The plasma (e.g., plasma loops) can form the secondary of a transformer.

The light source of the present invention also can include at least one port for introducing the ionizable medium into the chamber. The ionizable medium can be an ionizable fluid (i.e., a gas or liquid). The ionizable medium can include one or more gases, for example, one or more of the following gases: Xenon, Lithium, Nitrogen, Argon, Helium, Fluorine, Tin, Ammonia, Stannane, Krypton or Neon. The ionizable medium can be a solid (e.g., Tin or Lithium) that can be vaporized by a thermal process or sputtering process within the chamber or vaporized externally and then introduced into the chamber. The light source also can include an ionization source (e.g., an ultraviolet lamp, an RF source, a spark plug or a DC discharge source) for pre-ionizing the ionizable medium. The ionization source can also be inductive leakage current that flows from a second magnetic core to the magnetic core surrounding the portion of the plasma discharge region.

The light source can include an enclosure that at least partially encloses the magnetic core. The enclosure can define a plurality of holes in the enclosure. A plurality of plasma loops can pass through the plurality of holes when the magnetic core delivers power to the plasma. In some embodiments, the light source includes a single plasma loop that passes through a single hole when the magnetic core delivers power to the plasma. The plasma loops can collectively form the secondary circuit of a transformer. The enclosure can include two parallel (e.g., disk-shaped) plates. The parallel plates can be conductive and form a primary winding around the magnetic core. The enclosure can, for example, include or be formed from a metal material such as copper, tungsten, aluminum or one of a variety of copper-tungsten alloys. Coolant can flow through the enclosure for cooling a location adjacent the localized high intensity zone.

In some embodiments of the invention the light source can be configured to produce light for different uses. In other embodiments of the invention a light source can be configured to produce light at wavelengths shorter than about 100 nm when the light source generates a plasma discharge. In another embodiment of the invention a light source can be configured to produce light at wavelengths shorter than about 15 nm when the light source generates a plasma discharge. The light source can be configured to generate a plasma discharge suitable for semiconductor fabrication lithographic systems. The light source can be configured to generate a plasma discharge suitable for microscopy systems.

The invention, in another aspect, features an inductively-driven light source.

In another aspect of the invention, a light source features a chamber having a plasma discharge region and containing an ionizable material. The light source also includes a transformer having a first magnetic core that surrounds a portion of the plasma discharge region. The light source also includes a second magnetic core linked with the first magnetic core by a current. The light source also includes a power supply for providing a first signal (e.g., a voltage signal) to the second magnetic core, wherein the second magnetic core provides a second signal (e.g., a pulse of energy) to the first magnetic core when the second magnetic core saturates, and wherein the first magnetic core delivers power to a plasma formed in the plasma discharge region from the ionizable medium in response to the second signal. The light source can include a metallic material for conducting the current.

In another aspect of the invention, a light source includes a chamber having a channel region and containing an ionizable medium. The light source includes a magnetic core that surrounds a portion of the channel region and a pulse power system for providing at least one pulse of energy to the magnetic core for exciting the ionizable medium to form at least essentially a Z-pinch in the channel region. The current density of the plasma can be greater than about 1 KA/cm$^2$. The pressure in the channel region can be less than about 100 mTorr. In other embodiments, the pressure is less than about 1 Torr. In some embodiments, the pressure is about 200 mTorr.

In yet another aspect of the invention, a light source includes a chamber containing a light emitting plasma with a localized high-intensity zone that emits a substantial portion of the emitted light. The light source also includes a magnetic core that surrounds a portion of the non-uniform light emitting plasma. The light source also includes a pulse power system for providing at least one pulse of energy to the magnetic core for delivering power to the plasma.

In another aspect of the invention, a light source includes a chamber having a plasma discharge region and containing an ionizable medium. The light source also includes a magnetic core that surrounds a portion of the plasma discharge region. The light source also includes a means for providing at least one pulse of energy to the magnetic core for delivering power to a plasma formed in the plasma discharge region. The plasma has a localized high intensity zone.

In another aspect of the invention, a plasma source includes a chamber having a plasma discharge region and containing an ionizable medium. The plasma source also includes a magnetic core that surrounds a portion of the plasma discharge region and induces an electric current in the plasma sufficient to form a Z-pinch.

In general, in another aspect the invention relates to a method for generating a light signal. The method involves introducing an ionizable medium capable of generating a plasma into a chamber. The method also involves applying at least one pulse of energy to a magnetic core that surrounds a portion of a plasma discharge region within the chamber such that the magnetic core delivers power to the plasma. The plasma has a localized high intensity zone.

The method for generating the light signal can involve producing a non-uniformity in the plasma. The method also can involve localizing an emission of light by the plasma. The method also can involve producing a region of higher pressure to produce the non-uniformity.

The plasma can be a non-uniform plasma. The plasma can substantially vary in current density along a path of current flow in the plasma. The zone can be a point source of high intensity light. The zone can be a region where the plasma is pinched to form a neck. The zone can be created with a feature in the chamber. The zone can be created with gas pressure. The zone can be created with an output of the power system. Current flow in the plasma can create the zone.

The method also can involve locating an insert in the plasma discharge region. The insert can define a necked region for localizing an emission of light by the plasma. The insert can include a gas inlet and/or cooling capability. A non-uniformity can be produced in the plasma by a feature located in the chamber. The feature can be configured to substantially localize an emission of light by the plasma. The feature can be located remotely relative to the magnetic core.

The at least one pulse of energy provided to the magnetic core can form the plasma. Each pulse of energy can be pulsed at a frequency of between about 100 pulses per second and about 15,000 pulses per second. Each pulse of energy can be provided for a duration of time between about 10 ns and about 10 μs. The pulse power system can an energy storage device, for example, at least one capacitor and/or a second magnetic core.

In some embodiments, the method of the invention can involve discharging the at least one pulse of energy from the second magnetic core to the first magnetic core to deliver power to the plasma. The pulse power system can include, for example, a magnetic pulse-compression generator and/or a saturable inductor. The method can involve delivering each pulse of energy to the magnetic core by operation of a magnetic switch.

In some embodiments, the method of the invention can involve producing at least essentially a Z-pinch or essentially a capillary discharge in a channel region located in the chamber. In some embodiments the method can involve introducing the ionizable medium into the chamber via at least one port. The ionizable medium can include one or more gases, for example, one or more of the following gases: Xenon, Lithium, Nitrogen, Argon, Helium, Fluorine, Tin, Ammonia, Stannane, Krypton or Neon. The method also can involve pre-ionizing the ionizable medium with an ionization source (e.g., an ultraviolet lamp, an RF source, a spark plug or a DC discharge source). Alternatively or additionally, inductive leakage current flowing from a second magnetic core to the magnetic core surrounding the portion of the plasma discharge region can be used to pre-ionize the ionizable medium. In another embodiment, the ionizable medium can be a solid (e.g., Tin or Lithium) that can be vaporized by a thermal process or sputtering process within the chamber or vaporized externally and then introduced into the chamber.

In another embodiment of the invention the method can involve at least partially enclosing the magnetic core within an enclosure. The enclosure can include a plurality of holes. A plurality of plasma loops can pass through the plurality of holes when the magnetic core delivers power to the plasma. The plasma loops can collectively form the secondary circuit of a transformer. The enclosure can include two parallel plates. The two parallel plates can be used to form a primary winding around the magnetic core. The enclosure can include or be formed from a metal material, for example, copper, tungsten, aluminum or copper-tungsten alloys. Coolant can be provided to the enclosure to cool a location adjacent the localized high intensity location.

The method can involve alternately uncovering the plasma discharge region. A rotating disk can be used to alternately uncover the plasma discharge region and alternately define a feature that creates the localized high intensity zone. A coolant can be provided to a hollow region in the rotating disk.

In another embodiment the method can involve producing light at wavelengths shorter than about 100 nm. In another embodiment, the method can involve producing light at wavelengths shorter than about 15 nm. The method also can involve generating a plasma discharge suitable for semiconductor fabrication lithographic systems. The method also can involve generating a plasma discharge suitable for microscopy systems.

The invention, in another aspect, features a lithography system. The lithography system includes at least one light collection optic and at least one light condenser optic in optical communication with the at least one collection optic. The lithography system also includes a light source capable of generating light for collection by the at least one collection optic. The light source includes a chamber having a plasma discharge region and containing an ionizable medium. The light source also includes a magnetic core that surrounds a portion of the plasma discharge region and a pulse power system for providing at least one pulse of energy to the magnetic core for delivering power to a plasma formed in the plasma discharge region. The plasma has a localized high intensity zone.

In some embodiments of the invention, light emitted by the plasma is collected by the at least one collection optic, condensed by the at least one condenser optic and at least partially directed through a lithographic mask.

The invention, in another aspect, features an inductively-driven light source for illuminating a semiconductor wafer in a lithography system.

In general, in another aspect the invention relates to a method for illuminating a semiconductor wafer in a lithography system. The method involves introducing an ionizable medium capable of generating a plasma into a chamber. The method also involves applying at least one pulse of energy to a magnetic core that surrounds a portion of a plasma discharge region within the chamber such that the magnetic core delivers power to the plasma. The plasma has a localized high intensity zone. The method also involves collecting light emitted by the plasma, condensing the collected light; and directing at least part of the condensed light through a mask onto a surface of a semiconductor wafer.

The invention, in another aspect, features a microscopy system. The microscopy system includes a first optical element for collecting light and a second optical element for projecting an image of a sample onto a detector. The detector is in optical communication with the first and second optical elements. The microscopy system also includes a light source in optical communication with the first optical element. The light source includes a chamber having a plasma discharge region and containing an ionizable medium. The light source also includes a magnetic core that surrounds a portion of the plasma discharge region and a pulse power system for providing at least one pulse of energy to the magnetic core for delivering power to a plasma formed in the plasma discharge region. The plasma has a localized high intensity zone.

In some embodiments of the invention, light emitted by the plasma is collected by the first optical element to illuminate the sample and the second optical element projects an image of the sample onto the detector.

In general, in another aspect the invention relates to a microscopy method. The method involves introducing an ionizable medium capable of generating a plasma into a chamber. The method also involves applying at least one pulse of energy to a magnetic core that surrounds a portion of a plasma discharge region within the chamber such that the magnetic core delivers power to the plasma. The plasma has a localized high intensity zone. The method also involves collecting a light emitted by the plasma with a first optical element and projecting it through a sample. The method also involves projecting the light emitted through the sample to a detector.

Another aspect of the invention features an insert for an inductively-driven plasma light source. The insert has a body that defines at least one interior passage and has a first open end and a second open end. The insert has an outer surface adapted to couple or connect with an inductively-driven plasma light source in a plasma discharge region. In other embodiments, the outer surface of the insert is directly connected to the plasma light source. In other embodiments, the outer surface of the insert is indirectly connected to the plasma light source. In other embodiments, the outer surface of the insert is in physical contact with the plasma light source.

The at least one interior passage can define a region to create a localized high intensity zone in the plasma. The insert can be a consumable. The insert can be in thermal communication with a cooling structure.

In one embodiment, the outer surface of the insert couples or connects to the plasma light source by threads in a receptacle inside a chamber of the plasma light source. In another embodiment, the insert can slip fit into a receptacle inside a chamber of the plasma light source and tighten in place due to heating by the plasma (e.g., in the plasma discharge region).

In some embodiments, at least a surface of the at least one interior passage of the insert includes a material with a low plasma sputter rate (e.g., carbon, titanium, tungsten, diamond, graphite, silicon carbide, silicon, ruthenium, boron nitride or a refractory material). In other embodiments, a surface of at least one interior passage of the insert includes a material with both a low plasma sputter rate and a high thermal conductivity (e.g., highly oriented pyrolytic graphite (HOPG) or thermal pyrolytic graphite (TPG)). In another embodiment, a surface of at least one interior passage of the insert can be made of a material having a low absorption of EUV radiation (e.g., ruthenium or silicon).

The interior passage geometry of the insert can be used to control the size and shape of the plasma high intensity zone. The inner surface of the passage can define a reduced dimension of the passage. The geometry of the inner surface of the passage can be asymmetric about a midline between the two open ends. In another embodiment, the geometry of the inner surface can be defined by a radius of curvature which is substantially less than the minimum dimension across the passage. In another embodiment, the geometry of the inner surface can be defined by a radius of curvature between about 25% to about 100% of the minimum dimension across the passage.

The invention, in another aspect, features an insert for an inductively-driven plasma light source. The insert has a body defining at least one interior passage and has a first open end and a second open end. The insert also has a means for coupling or connecting with an inductively-driven light source in a plasma discharge region.

The insert can be defined by two or more bodies. The insert can have at least one gas inlet hole in the body. In another embodiment, the insert can have at least one cooling channel passing through the body. In one embodiment, the insert is replaced using a robotic arm.

The invention, in another aspect, features a light source. The light source includes a chamber having a plasma discharge region and containing an ionizable medium. The light source also includes a magnetic core that surrounds a portion of the plasma discharge region. The light source also includes a power system for providing energy to the magnetic core for delivering power to a plasma formed in the plasma discharge region, wherein the plasma has a localized high intensity zone. The light source also includes a filter disposed relative to the light source to reduce indirect or direct plasma emissions.

The filter can be configured to maximize collisions with emissions which are not traveling parallel to radiation emanating from the light source (e.g., from the high intensity zone). The filter can be configured to minimize reduction of emissions traveling parallel to radiation emanating from the light source (e.g., from the high intensity zone). In one embodiment, the filter is made up of walls which are substantially parallel to the direction of radiation emanating from the high intensity zone, and has channels between the walls. A curtain of gas can be maintained in the vicinity of the filter to increase collisions between the filter and emissions other than radiation.

In another embodiment, the filter can have cooling channels. The surfaces of the filter which are exposed to the emissions can comprise a material with a low plasma sputter rate (e.g., carbon, titanium, tungsten, diamond, graphite, silicon carbide, silicon, ruthenium, or a refractory material). In another embodiment, the surfaces of the filter which are exposed to the emissions can comprise a material with both a low plasma sputter rate and a high thermal conductivity (e.g., highly oriented pyrolytic graphite or thermal pyrolytic graphite).

In another aspect, the invention relates to a method for generating a light signal. The method includes introducing an ionizable medium capable of generating a plasma into a chamber. The method also includes applying energy to a magnetic core that surrounds a portion of a plasma discharge region within the chamber such that the magnetic core delivers power to the plasma. The plasma has a localized high intensity zone. The inventive method also includes filtering emissions emanating from the localized high intensity zone of the plasma.

In one embodiment, the method includes positioning the filter relative to the high intensity zone (e.g., a source of light) to reduce direct or indirect emissions. The method can include maximizing collisions with emissions which are not traveling parallel to radiation emanating from the high intensity zone. The method can include minimizing reduction of emissions traveling parallel to the radiation emanating from the high intensity zone.

In one embodiment, this method can include locating walls which are substantially parallel to the direction of radiation emanating from the high intensity zone and positioning channels between the walls. The surfaces of the filter which are exposed to the emissions can comprise a material with a low plasma sputter rate (e.g., carbon, titanium, tungsten, diamond, graphite, silicon carbide, silicon, ruthenium, or a refractory material). In another embodiment, the surfaces of the filter which are exposed to the emissions can comprise a material with both a low plasma sputter rate and a high thermal conductivity (e.g., highly oriented pyrolytic graphite or thermal pyrolytic graphite).

The invention, in another aspect, features a light source. The light source includes a chamber having a plasma discharge region and containing an ionizable material. The light source also includes a magnetic core that surrounds a portion of the plasma discharge region. The light source also includes a power system for providing energy to the magnetic core for delivering power to a plasma formed in the plasma discharge region and having a localized high intensity zone. The light source also includes means for minimal reduction of emissions traveling substantially parallel to the direction of radiation emitted from the high intensity zone. The light source also includes means for maximal reduction of emissions traveling other than substantially parallel to the direction of the radiation emitted from the high intensity zone.

The invention, in another aspect, features an inductively-driven plasma source. The plasma source includes a chamber having a plasma discharge region and containing an ionizable medium. The plasma source also includes a system for spreading heat flux and ion flux over a large surface area. This system uses at least one object, located within the plasma chamber, where at least the outer surface of the object moves with respect to the plasma. At least one of the objects is in thermal communication with a cooling channel.

In another embodiment, the outer surface of at least one of the objects can include a sacrificial layer. The sacrificial layer can be continuously coated on the outer surface. The sacrificial layer can be made from a material which emits EUV radiation (e.g., lithium or tin).

In another embodiment, the objects can be two or more closely spaced rods. The space between the rods can define a region to create a localized high intensity zone in the plasma. In another embodiment, a local geometry of the at least one object can define a region to create a localized high intensity zone in the plasma.

In general, in another aspect, the invention relates to a method for generating an inductively-driven plasma. The method includes introducing an ionizable medium capable of generating a plasma in a chamber and applying energy to a magnetic core surrounding a plasma discharge region in the chamber. The method also includes spreading the heat flux and ion flux from the inductively-driven plasma over a large surface area. The method includes locating at least one object within a region of the plasma and moving at least an outer surface of the at least one object with respect to the plasma.

The method also includes providing the at least one object with a cooling channel in thermal communication with the at least one object. In this method, the plasma can erode a sacrificial layer from the outer surface of the object. In another embodiment, the method can include continuously coating the outer surface of the at least one object with the sacrificial layer. The sacrificial layer can be formed of a material which emits EUV radiation (e.g., lithium or tin).

The method can further include placing the at least one object in such a way as to create a localized high intensity zone in the plasma. The method can also involve locating a second object relative to the first object in order to define a region to create a localized high intensity zone in the plasma.

The invention, in one aspect, features a light source. The light source includes a chamber having a plasma discharge region and containing an ionizable medium. The light source also includes a magnetic core that surrounds a portion of the plasma discharge region. The light source also includes a pulse power system for providing at least one pulse of energy to the magnetic core for delivering power to a plasma formed in the plasma discharge region. The plasma has a localized high intensity zone. The light source includes a magnet located in the chamber to modify a shape of the plasma. In one embodiment, the magnet is inside the plasma discharge region and can create the localized high intensity zone. The magnet can be a permanent magnet or an electromagnet. In another embodiment, the magnet can be located adjacent the high intensity zone.

The invention, in another aspect, relates to a method for operating an EUV light source. EUV light is generated in a chamber using a plasma. A consumable is provided which defines a localized region of high intensity in the plasma. The method also includes replacing (e.g., with a robotic arm) the consumable based on a selected criterion without exposing the chamber to atmospheric conditions. In some embodiments, the selected criterion is one or more of a predetermined time, a measured degradation of the consumable, or a measured degradation of a process control variable associated with operation of the light source. In some embodiments, the selected criterion is a measured degradation of a process control variable associated with operation of a system (e.g., lithography system, microscopy system, or other semiconductor processing system).

The method can also include maintaining a vacuum in the chamber during replacement of the consumable. The plasma light source can be an inductively-driven plasma light source. The consumable can be an insert.

The invention, in another aspect, features a light source. The light source includes a chamber having a plasma discharge region and containing an ionizable medium. The light source also includes a magnetic core that surrounds a portion of the plasma discharge region and a pulse power system for providing at least one pulse of energy to the magnetic core for delivering power to a plasma formed in the plasma discharge region that forms a secondary circuit of a transformer. The light source also includes a disk having an aperture confining a localized high intensity zone of the plasma.

In some embodiments, the aperture is configured to substantially localize an emission of light by the localized high intensity zone of the plasma. In some embodiments, the disk comprises cooling capability. The disk can include a plurality of apertures. The disk can be rotated to locate one of the plurality of apertures in a region of the light source to create the localized high intensity zone. The rotation of the disk can sequentially locate another of the plurality of apertures in the region of the light source to create the localized high intensity zone. In some embodiments, the pulse of energy is provided to the magnetic core when the one of the plurality of apertures is located in the region of the light source. The rotation of the disk can be synchronized with pulse rate of the pulse power system to locate at least one of the apertures in the region of the light source.

In some embodiments, the light source includes a rotary drive coupled to the disk. The rotary drive can be supplied by a tool or piece of equipment comprising the light source. In some embodiments, the light source also includes a gas inlet. In some embodiments, the disk includes the gas inlet. In some embodiments, the ionizable medium is provided to the aperture via the gas inlet. In some embodiments, the ionizable medium is provided to the aperture prior to locating the aperture in the region.

In some embodiments, the light source includes at least one conduit in communication with at least one aperture for a period of time during the rotation of the disk. The at least one conduit can be an inlet or pressure measurement conduit. In some embodiments, the light source includes a pressure measurement device. The pressure measurement device can measure pressure of the ionizable medium in the aperture prior to locating the aperture in the region.

The ionizable medium can be a solid, liquid or gas. The ionizable medium can be at least one or more solid, liquid or gas selected from the group consisting of Xenon, Lithium, Tin, Nitrogen, Argon, Helium, Fluorine, Ammonia, Stannane, Krypton and Neon.

In some embodiments, the light source includes an insert located in the aperture. In some embodiments, the insert is shrink fit into the aperture. In some embodiments, at least one interior passage of the insert defines a region to create the localized high intensity zone in the plasma. The insert can be a consumable. In some embodiments, the insert comprises a silicon carbide material. In some embodiments, the ionizable medium is provided to the interior passage of the insert via the gas inlet.

In some embodiments, the light source includes a rotating shaft coupled to the disk. Coolant can be provided to an interior region of the disk via the shaft. In some embodiments, coolant in the interior region of the disk cools the disk based on a heat-pipe principle. In some embodiments, coolant is pumped through the interior region of the disk. In some embodiments, coolant cools the plurality of apertures.

The invention, in another aspect, relates to a method for generating a light signal. The method involves introducing an ionizable medium capable of generating a plasma into a chamber. The method also involves applying at least one pulse of energy to a magnetic core that surrounds a portion of a plasma discharge region within the chamber such that the magnetic core delivers power to the plasma that forms a secondary circuit of a transformer. The method also involves confining a localized high intensity zone of the plasma with an aperture of a disk.

In some embodiments, the aperture is configured to substantially localize an emission of light by the plasma. In some embodiments, the disk includes a plurality of apertures. In some embodiments, the method involves rotating the disk to locate one of the plurality of apertures in a region of the plasma to create the localized high intensity zone. In some embodiments, the method comprising rotating the disk to sequentially locate another of the plurality of apertures in the region of the plasma to create the localized high intensity zone.

In some embodiments, the method involves applying the pulse of energy to the magnetic core when one of the plurality of apertures is located in the region of the plasma having the localized high intensity zone. In some embodiments, the method involves synchronizing pulse rate of pulses of energy applied to the magnetic core with rotation of the disk. In some embodiments, the ionizable medium is introduced via a gas inlet. In some embodiments, the ionizable medium is introduced to the aperture via a gas inlet. In some embodiments, the method involves introducing the ionizable medium to the aperture prior to locating the aperture in the region of the plasma having the localized high intensity zone.

In some embodiments, the method involves measuring pressure of the ionizable medium in the aperture prior to locating the aperture in the region of the plasma having the localized high intensity zone. In some embodiments, the method involves providing coolant to an interior region of the disk via a shaft coupled to the disk. In some embodiments, the method involves pumping coolant through the interior region of the disk.

The invention, in another aspect, features a light source that includes means for introducing an ionizable medium capable of generating a plasma into a chamber. The light source also includes means for applying at least one pulse of energy to a magnetic core that surrounds a portion of a plasma discharge region within the chamber such that the magnetic core delivers power to the plasma that forms a secondary circuit of a transformer. The light source also includes means for confining a localized high intensity zone of the plasma with an aperture of a disk.

The invention, in another aspect, features a system for distributing heat from an inductively-driven plasma. The system includes a rotating disk that has a plurality of apertures disposed within a region of a plasma in an inductively-driven plasma source. The system also includes a cooling channel in thermal communication with an interior region of the disk.

In some embodiments, system also includes a rotating shaft coupled to the disk. Coolant can be provided to the interior region of the disk via the shaft. In some embodiments, coolant in the cooling channel cools the disk based on a heat-pipe principle. Coolant can be pumped through the interior region of the disk. In some embodiments, coolant cools the plurality of apertures.

The invention, in another aspect, relates to a method for distributing heat from an inductively-driven plasma. The method involves rotating a disk that has a plurality of apertures disposed within a region of a plasma in an inductively-driven plasma source. The method also involves providing coolant to a cooling channel in thermal communication with an interior region of the disk.

In some embodiments, the method involves pumping coolant through the cooling channel. In some embodiments, the cooling channel is a portion of a shaft coupled to the rotating disk.

The foregoing and other objects, aspects, features, and advantages of the invention will become more apparent from the following description and from the claims.

BRIEF DESCRIPTION OF THE DRAWINGS

The foregoing and other objects, feature and advantages of the invention, as well as the invention itself, will be more fully understood from the following illustrative description, when read together with the accompanying drawings which are not necessarily to scale.

DETAILED DESCRIPTION OF ILLUSTRATIVE EMBODIMENTS

Figure 1:
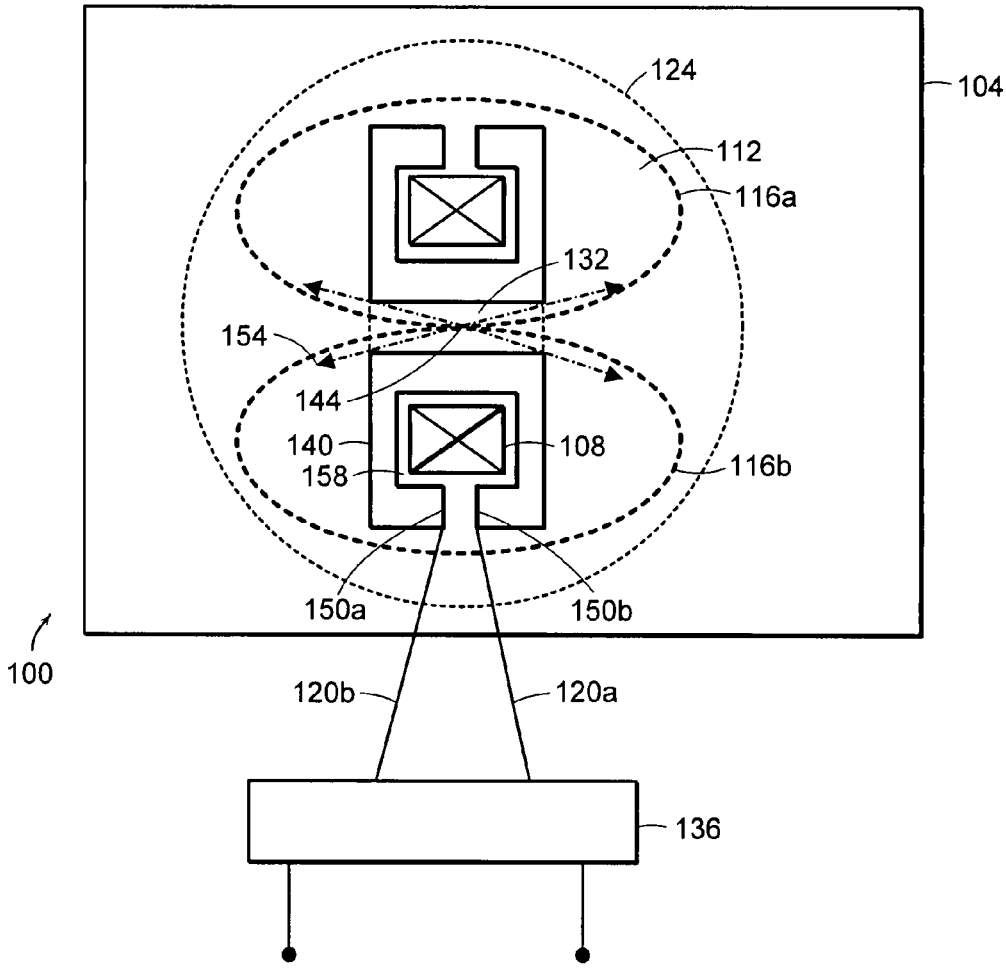
FIG. 1 is a cross-sectional view of a magnetic core surrounding a portion of a plasma discharge region, according to an illustrative embodiment of the invention.

FIG. 1 is a cross-sectional view of a plasma source 100 for generating a plasma that embodies the invention. The plasma source 100 includes a chamber 104 that defines a plasma discharge region 112. The chamber 104 contains an ionizable medium that is used to generate a plasma (shown as two plasma loops 116*a* and 116*b*) in the plasma discharge region 112. The plasma source 100 includes a transformer 124 that induces an electric current into the two plasma loops 116*a* and 116*b* (generally 116) formed in the plasma discharge region 112. The plasma loops collectively form the secondary circuit of a transformer. The transformer 124 includes a magnetic core 108 and a primary winding 140. A gap 158 is located between the winding 140 and the magnetic core 108.

In this embodiment, the winding 140 is a copper enclosure that at least partially encloses the magnetic core 108 and that provides a conductive path that at least partially encircles the magnetic core 108. The copper enclosure is electrically equivalent to a single turn winding that encircles the magnetic core 108. In another embodiment, the plasma source 100 instead includes an enclosure that at least partially encloses the magnetic core 108 in the chamber 104 and a separate metal (e.g., copper or aluminum) strip that at least partially encircles the magnetic core 108. In this embodiment, the metal strip is located in the gap 158 between the enclosure and the magnetic core 108 and is the primary winding of the magnetic core 108 of the transformer 124.

The plasma source 100 also includes a power system 136 for delivering energy to the magnetic core 108. In this embodiment, the power system 136 is a pulse power system that delivers at least one pulse of energy to the magnetic core 108. In operation, the power system 136 typically delivers a series of pulses of energy to the magnetic core 108 for delivering power to the plasma. The power system 136 delivers pulses of energy to the transformer 124 via electrical connections 120*a* and 120*b* (generally 120). The pulses of energy induce a flow of electric current in the magnetic core 108 that delivers power to the plasma loops 116*a* and 116*b* in the plasma discharge region 112. The magnitude of the power delivered to the plasma loops 116*a* and 116*b* depends on the magnetic field produced by the magnetic core 108 and the frequency and duration of the pulses of energy delivered to the transformer 124 according to Faraday's law of induction.

In some embodiments, the power system 136 provides pulses of energy to the magnetic core 108 at a frequency of between about 1 pulse and about 50,000 pulses per second. In certain embodiments, the power system 136 provides pulses of energy to the magnetic core 108 at a frequency of between about 100 pulses and 15,000 pulses per second. In certain embodiments, the pulses of energy are provide to the magnetic core 108 for a duration of time between about 10 ns and about 10 μs. The power system 136 may include an energy storage device (e.g., a capacitor) that stores energy prior to delivering a pulse of energy to the magnetic core 108. In some embodiments, the power system 136 includes a second magnetic core. In certain embodiments, the second magnetic core discharges pulses of energy to the first magnetic core 108 to deliver power to the plasma. In some embodiments, the power system 136 includes a magnetic pulse-compression generator and/or a saturable inductor. In other embodiments, the power system 136 includes a magnetic switch for selectively delivering the pulse of energy to the magnetic core 108. In certain embodiments, the pulse of energy can be selectively delivered to coincide with a predefined or operator-defined duty cycle of the plasma source 100. In other embodiments, the pulse of energy can be delivered to the magnetic core when, for example, a saturable inductor becomes saturated.

The plasma source 100 also may include a means for generating free charges in the chamber 104 that provides an initial ionization event that pre-ionizes the ionizable medium to ignite the plasma loops 116*a* and 116*b* in the chamber 104. Free charges can be generated in the chamber by an ionization source, such as, an ultraviolet light, an RF source, a spark plug or a DC discharge source. Alternatively or additionally, inductive leakage current flowing from a second magnetic core in the power system 136 to the magnetic core 108 can pre-ionize the ionizable medium. In certain embodiments, the ionizable medium is pre-ionized by one or more ionization sources.

The ionizable medium can be an ionizable fluid (i.e., a gas or liquid). By way of example, the ionizable medium can be a gas, such as Xenon, Lithium, Tin, Nitrogen, Argon, Helium, Fluorine, Ammonia, Stannane, Krypton or Neon. Alternatively, the ionizable medium can be finely divided particle (e.g., Tin) introduced through at least one gas port into the chamber 104 with a carrier gas, such as helium. In another embodiment, the ionizable medium can be a solid (e.g., Tin or Lithium) that can be vaporized by a thermal process or sputtering process within the chamber or vaporized externally and then introduced into the chamber 104. In certain embodiments, the plasma source 100 includes a vapor generator (not shown) that vaporizes the metal and introduces the vaporized metal into the chamber 104. In certain embodiments, the plasma source 100 also includes a heating module for heating the vaporized metal in the chamber 104. The chamber 104 may be formed, at least in part, from a metallic material such as copper, tungsten, a copper-tungsten alloy or any material suitable for containing the ionizable medium and the plasma and for otherwise supporting the operation of the plasma source 100.

Referring to FIG. 1, the plasma loops 116*a* and 116*b* converge in a channel region 132 defined by the magnetic core 108 and the winding 140. In one exemplary embodiment, pressure in the channel region is less than about 100 mTorr. In other embodiments, the pressure is less than about 1 Torr. In some embodiments, the pressure is about 200 mTorr. Energy intensity varies along the path of a plasma loop if the cross-sectional area of the plasma loop varies along the length of the plasma loop. Energy intensity may therefore be altered along the path of a plasma loop by use of features or forces that alter cross-sectional area of the plasma loop. Altering the cross-sectional area of a plasma loop is also referred to herein as constricting the flow of current in the plasma or pinching the plasma loop. Accordingly, the energy intensity is greater at a location along the path of the plasma loop where the cross-sectional area is decreased. Similarly, the energy intensity is lower at a given point along the path of the plasma loop where the cross-sectional area is increased. It is therefore possible to create locations with higher or lower energy intensity.

Constricting the flow of current in a plasma is also sometimes referred to as producing a Z-pinch or a capillary discharge. A Z-pinch in a plasma is characterized by the plasma decreasing in cross-sectional area at a specific location along the path of the plasma. The plasma decreases in cross-sectional area as a result of the current that is flowing through the cross-sectional area of the plasma at the specific location.

Generally, a magnetic field is generated due to the current in the plasma and, the magnetic field confines and compresses the plasma. In this case, the plasma carries an induced current along the plasma path and a resulting magnetic field surrounds and compresses the plasma. This effect is strongest where the cross-sectional area of the plasma is minimum and works to further compress the cross-sectional area, hence further increasing the current density in the plasma.

In one embodiment, the channel 132 is a region of decreased cross-sectional area relative to other locations along the path of the plasma loops 116*a* and 116*b*. As such, the energy intensity is increased in the plasma loops 116*a* and 116*b* within the channel 132 relative to the energy intensity in other locations of the plasma loops 116*a* and 116*b*. The increased energy intensity increases the emitted electromagnetic energy (e.g., emitted light) in the channel 132.

The plasma loops 116*a* and 116*b* also have a localized high intensity zone 144 as a result of the increased energy intensity. In certain embodiments, a high intensity light 154 is produced in and emitted from the zone 144 due to the increased energy intensity. Current density substantially varies along the path of the current flow in the plasma loops 116*a* and 116*b*. In one exemplary embodiment, the current density of the plasma is in the localized high intensity zone is greater than about 1 $KA/cm^2$. In some embodiments, the zone 144 is a point source of high intensity light and is a region where the plasma loops 116*a* and 116*b* are pinched to form a neck.

In some embodiments, a feature is located in the chamber 104 that creates the zone 144. In certain embodiments, the feature produces a non-uniformity in the plasma loops 116*a* and 116*b*. The feature is permanent in some embodiments and removable in other embodiments. In some embodiments, the feature is configured to substantially localize an emission of light by the plasma loops 116*a* and 116*b* to, for example, create a point source of high intensity electromagnetic radiation. In other embodiments, the feature is located remotely relative to the magnetic core 108. In certain embodiments, the remotely located feature creates the localized high intensity zone in the plasma in a location remote to the magnetic core 108 in the chamber 104. For example, the disk 308 of FIGS. 3A and 3B discussed later herein is located remotely relative to the magnetic core 108. In certain embodiment, a gas inlet is located remotely from the magnetic core to create a region of higher pressure to create a localized high intensity zone.

In some embodiments, the feature is an insert that defines a necked region. In certain embodiments, the insert localizes an emission of light by the plasma in the necked region. In certain other embodiments, the insert includes a gas inlet for, for example, introducing the ionizable medium into the chamber 104. In other embodiments, the feature includes cooling capability for cooling a region of the feature. In certain embodiments, the cooling capability involves subcooled flow boiling as described by, for example, S. G. Kandlikar "*Heat Transfer Characteristics in Partial Boiling, Fully Developed Boiling, and Significant Void Flow Regions of Subcooled Flow Boiling*" Journal of Heat Transfer Feb. 2, 1998. In certain embodiments, the cooling capability involves pressurized subcooled flow boiling. In other embodiments, the insert includes cooling capability for cooling a region of the insert adjacent to, for example, the zone 144.

In some embodiments, gas pressure creates the localized high intensity zone 144 by, for example, producing a region of higher pressure at least partially around a portion of the plasma loops 116*a* and 116*b*. The plasma loops 16*a* and 116*b* are pinched in the region of high pressure due to the increased gas pressure. In certain embodiments, a gas inlet is the feature that introduces a gas into the chamber 104 to increase gas pressure. In yet another embodiment, an output of the power system 136 can create the localized high intensity zone 144 in the plasma loops 116*a* and 116*b*.

Figure 2:
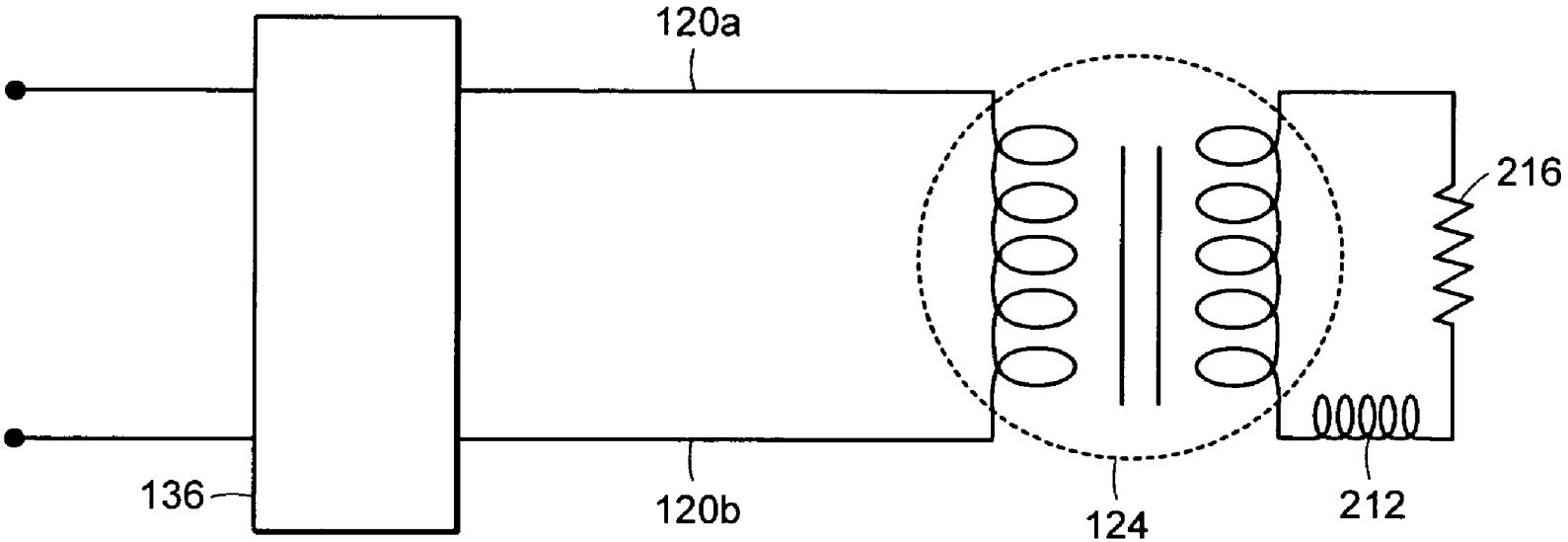
FIG. 2 is a schematic electrical circuit model of a plasma source, according to an illustrative embodiment of the invention.

FIG. 2 is a schematic electrical circuit model 200 of a plasma source, for example the plasma source 100 of FIG. 1. The model 200 includes a power system 136, according to one embodiment of the invention. The power system 136 is electrically connected to a transformer, such as the transformer 124 of FIG. 1. The model 200 also includes an inductive element 212 that is a portion of the electrical inductance of the plasma, such as the plasma loops 116*a* and 116*b* of FIG. 1. The model 200 also includes a resistive element 216 that is a portion of the electrical resistance of the plasma, such as the plasma loops 116*a* and 116*b* of FIG. 1. In this embodiment, the power system is a pulse power system that delivers via electrical connections 120*a* and 120*b* a pulse of energy to the transformer 124. The pulse of energy is then delivered to the plasma by, for example, a magnetic core which is a component of the transformer, such as the magnetic core 108 of the transformer 124 of FIG. 1.

Figures 3A, 3B:
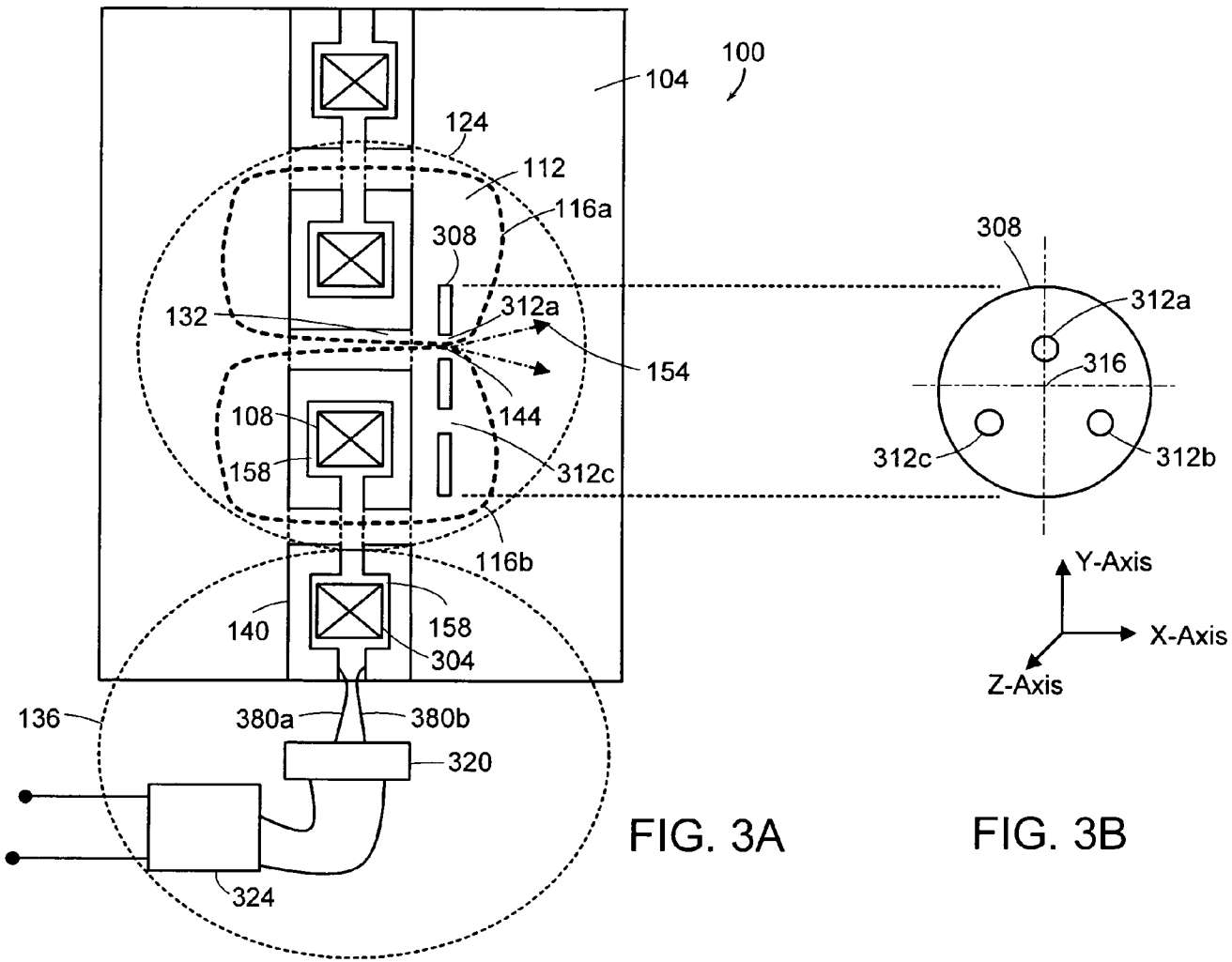
FIG. 3A is a cross-sectional view of two magnetic cores and a feature for producing a non-uniformity in a plasma, according to another illustrative embodiment of the invention.
FIG. 3B is a blow-up view of a region of FIG. 3A.

In another embodiment, illustrated in FIGS. 3A and 3B, the plasma source 100 includes a chamber 104 that defines a plasma discharge region 112. The chamber 104 contains an ionizable medium that is used to generate a plasma in the plasma discharge region 112. The plasma source 100 includes a transformer 124 that couples electromagnetic energy into two plasma loops 116*a* and 116*b* (generally 116) formed in the plasma discharge region 112. The transformer 124 includes a first magnetic core 108. The plasma source 100 also includes a winding 140. In this embodiment, the winding 140 is an enclosure for locating the magnetic cores 108 and 304 in the chamber 104. The winding 104 is also a primary winding of magnetic core 108 and a winding for magnetic core 304.

The winding 140 around the first magnetic core 108 forms the primary winding of the transformer 124. In this embodiment, the second magnetic core and the winding 140 are part of the power system 136 and form a saturable inductor that delivers a pulse of energy to the first magnetic core 108. The power system 136 includes a capacitor 320 that is electrically connected via connections 380*a* and 380*b* to the winding 140. In certain embodiments, the capacitor 320 stores energy that is selectively delivered to the first magnetic core 108. A voltage supply 324, which may be a line voltage supply or a bus voltage supply, is coupled to the capacitor 320.

The plasma source 100 also includes a disk 308 that creates a localized high intensity zone 144 in the plasma loops 116*a* and 116*b*. In this embodiment, the disk 308 is located remotely relative to the first magnetic core 108. The disk 308 rotates around the Z-axis of the disk 308 (referring to FIG. 3B) at a point of rotation 316 of the disk 308. The disk 308 has three apertures 312*a*, 312*b* and 312*c* (generally 312) that are located equally angularly spaced around the disk 308. The apertures 312 are located in the disk 308 such that at any angular orientation of the disk 308 rotated around the Z-Axis only one (e.g., aperture 312*a* in FIGS. 3A and 3B) of the three apertures 312*a*, 312*b* and 312*c* is aligned with the channel 132 located within the core 108. In this manner, the disk 308 can be rotated around the Z-axis such that the channel 132 may be alternately uncovered (e.g., when aligned with an aperture 312) and covered (e.g., when not aligned with an aperture 312). The disk 308 is configured to pinch (i.e., decrease the cross-sectional area of) the two plasma loops 116*a* and 116*b* in the aperture 312*a*. In this manner, the apertures 312 are features in the disk of the plasma source 100 that create the localized high intensity zone 144 in the plasma loops 316*a* and 316*b*. By pinching the two plasma loops 116*a* and 116*b* in the location of the aperture 312*a* the energy intensity of the two plasma loops 116*a* and 116*b* in the location of the aperture 312*a* is greater than the energy intensity in a cross-section of the plasma loops 116*a* and 116*b* in other locations along the current paths of the plasma loops 116*a* and 116*b*.

It is understood that variations on, for example, the geometry of the disk 308 and the number and or shape of the apertures 312 is contemplated by the description herein. In one embodiment, the disk 308 is a stationary disk having at least one aperture 312. In some embodiments, the disk 308 has a hollow region (not shown) for carrying coolant to cool a region of the disk 308 adjacent the localized high intensity zone 144. In some embodiments, the plasma source 100 includes a thin gas layer that conducts heat from the disk 308 to a cooled surface in the chamber 104.

Figure 4:
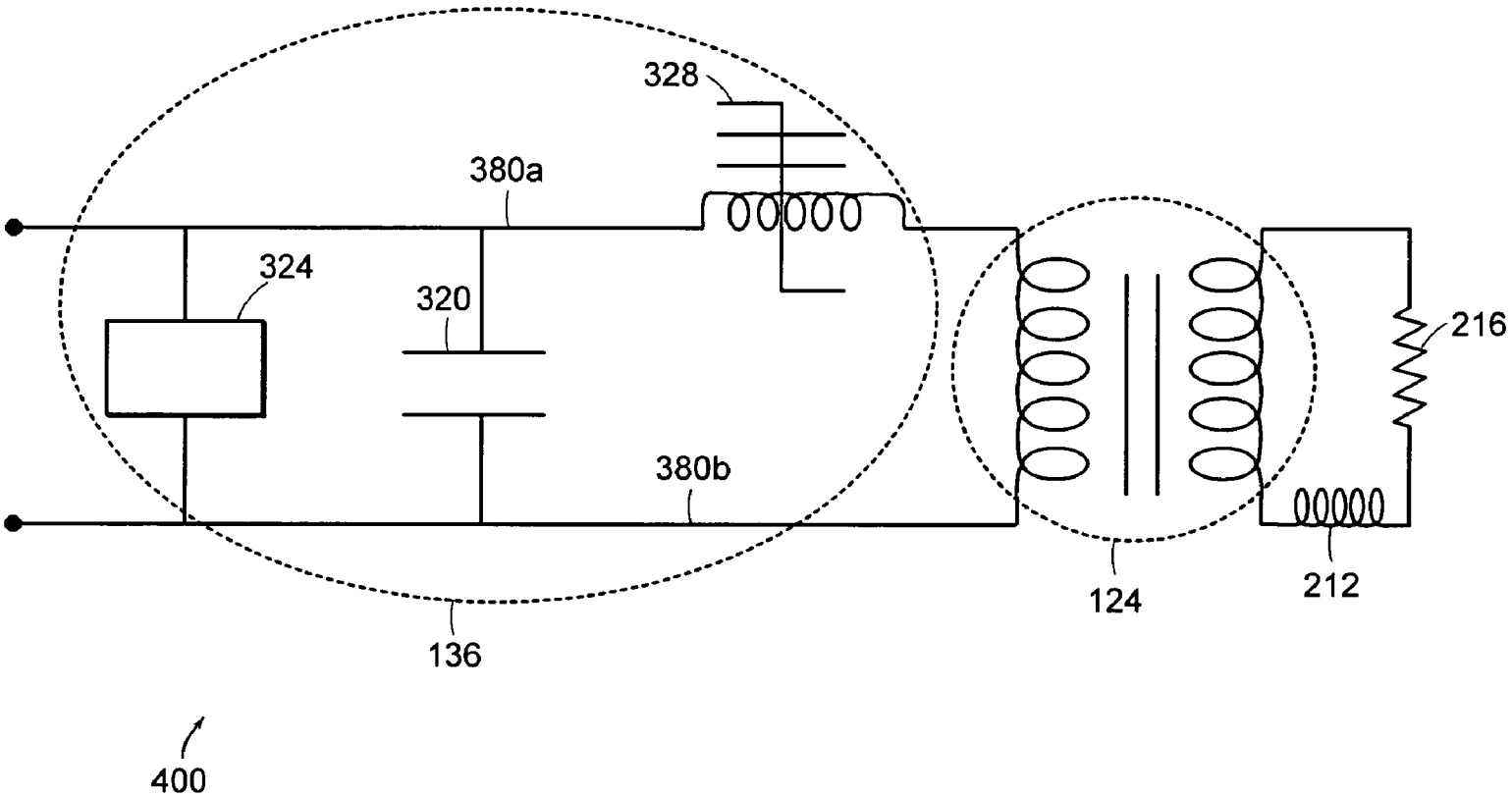
FIG. 4 is a schematic electrical circuit model of a plasma source, according to an illustrative embodiment of the invention.

FIG. 4 illustrates an electrical circuit model 400 of a plasma source, such as the plasma source 100 of FIGS. 3A and 3B. The model 400 includes a power system 136 that is electrically connected to a transformer, such as the transformer 124 of FIG. 3A. The model 400 also includes an inductive element 212 that is a portion of the electrical inductance of the plasma. The model 400 also includes a resistive element 216 that is a portion of the resistance of the plasma. A pulse power system 136 delivers via electrical connections 380*a* and 380*b* pulses of energy to the transformer 124. The power system 136 includes a voltage supply 324 that charges the capacitor 320. The power system 136 also includes a saturable inductor 328 which is a magnetic switch that delivers energy stored in the capacitor 320 to the first magnetic core 108 when the inductor 328 becomes saturated.

In some embodiments, the capacitor 320 is a plurality of capacitors that are connected in parallel. In certain embodiments, the saturable inductor 328 is a plurality of saturable inductors that form, in part, a magnetic pulse-compression generator. The magnetic pulse-compression generator compresses the pulse duration of the pulse of energy that is delivered to the first magnetic core 108.

Figure 5A:
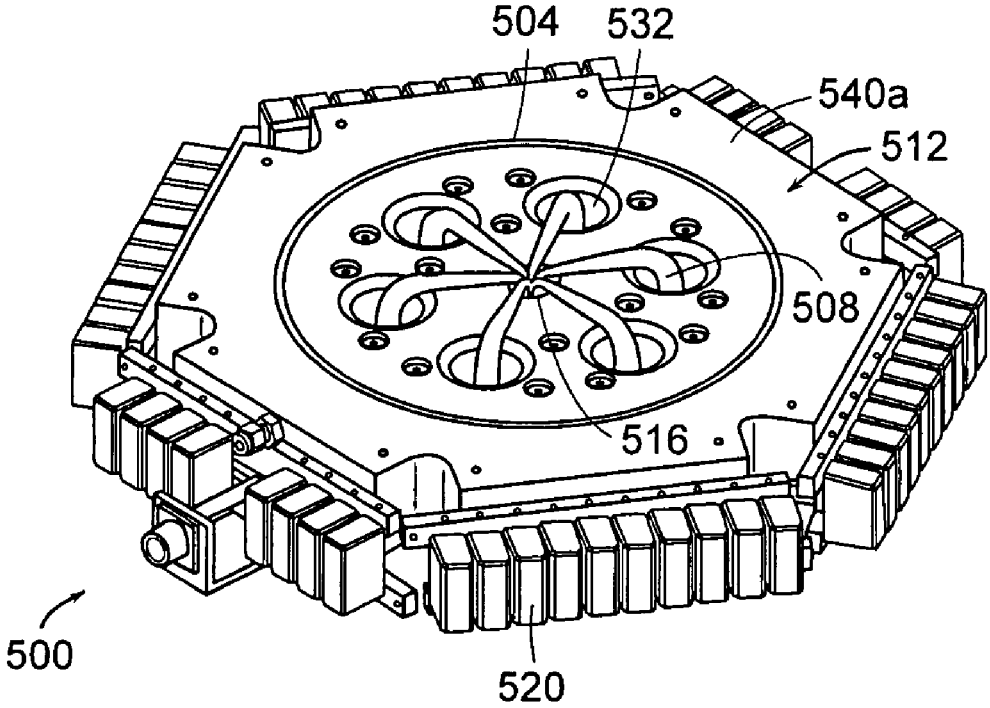
FIG. 5A is an isometric view of a plasma source, according to an illustrative embodiment of the invention.
Figure 5B:
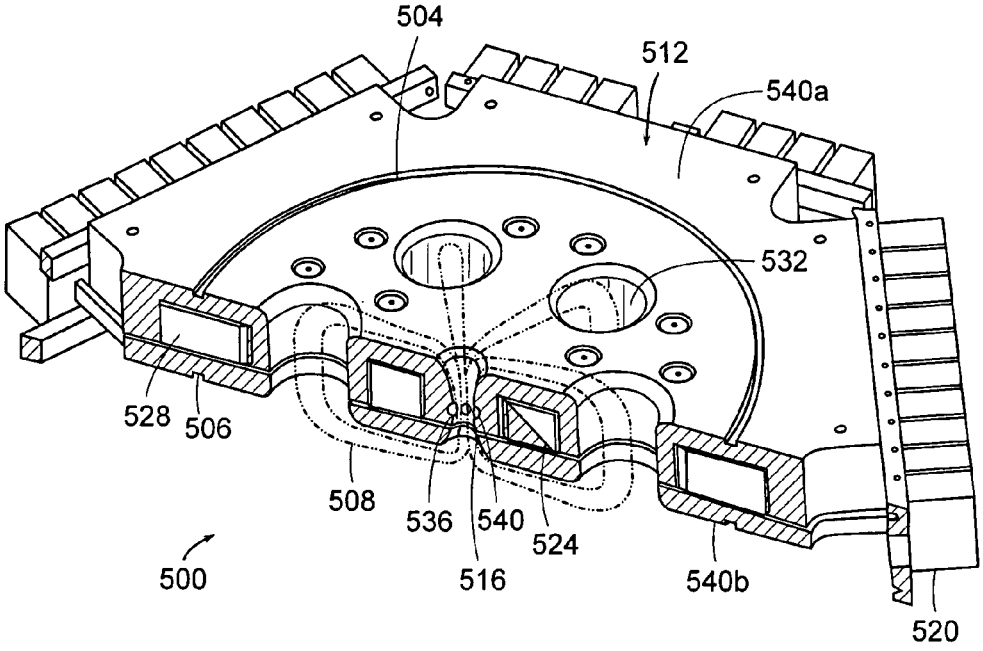
FIG. 5B is a cutaway view of the plasma source of FIG. 5A.

In another embodiment, illustrated in FIGS. 5A and 5B, a portion of a plasma source 500 includes an enclosure 512 that, at least, partially encloses a first magnetic core 524 and a second magnetic core 528. In this embodiment, the enclosure 512 has two conductive parallel plates 540*a* and 540*b* that form a conductive path at least partially around the first magnetic core 524 and form a primary winding around the first magnetic core 524 of a transformer, such as the transformer 124 of FIG. 4. The parallel plates 540*a* and 540*b* also form a conductive path at least partially around the second magnetic core 528 forming an inductor, such as the inductor 328 of FIG. 4. The plasma source 500 also includes a plurality of capacitors 520 located around the outer circumference of the enclosure 512. By way of example, the capacitors 520 can be the capacitor 320 of FIG. 4.

The enclosure 512 defines at least two holes 516 and 532 that pass through the enclosure 512. In this embodiment, there are six holes 532 that are located equally angularly spaced around a diameter of the plasma source 500. Hole 516 is a single hole through the enclosure 512. In one embodiment, the six plasma loops 508 each converge and pass through the hole 516 as a single current carrying plasma path. The six plasma loops also each pass through one of the six holes 532. The parallel plates 540*a* and 540*b* have a groove 504 and 506, respectively. The grooves 504 and 506 each locate an annular element (not shown) for creating a pressurized seal and for defining a chamber, such as the chamber 104 of FIG. 3A, which encloses the plasma loops 508 during operation of the plasma source 500.

The hole 516 in the enclosure defines a necked region 536. The necked region 536 is a region of decreased cross-section area relative to other locations along the length of the hole 516. As such, the energy intensity is increased in the plasma loops 508, at least, in the necked region 536 forming a localized high intensity zone in the plasma loops 508 in the necked region 536. In this embodiment, there also are a series of holes 540 located in the necked region 536. The holes 540 may be, for example, gas inlets for introducing the ionizable medium into the chamber of the plasma source 500. In other embodiments, the enclosure 512 includes a coolant passage (not shown) for flowing coolant through the enclosure for cooling a location of the enclosure 512 adjacent the localized high intensity zone.

Figure 6:
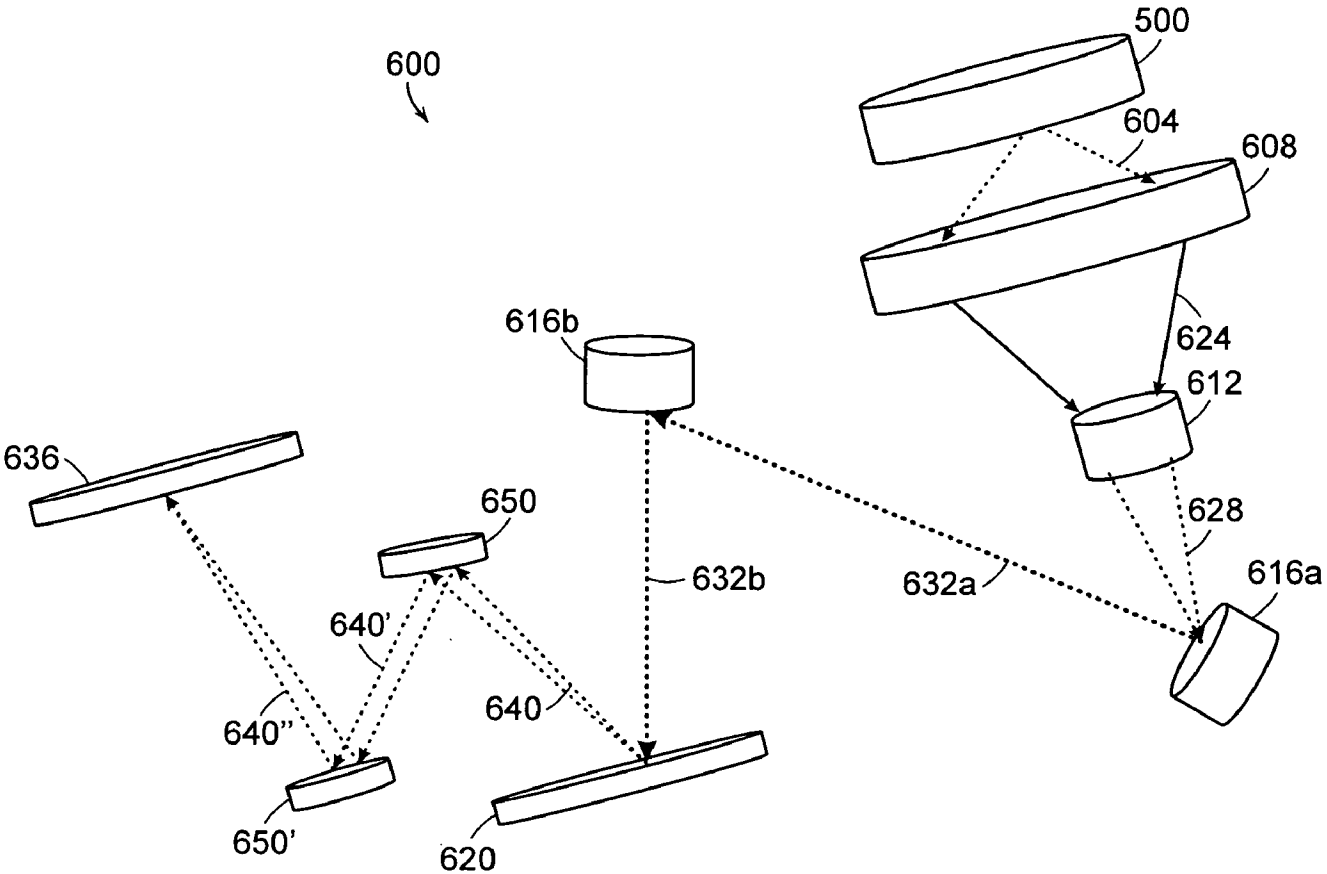
FIG. 6 is a schematic block diagram of a lithography system, according to an illustrative embodiment of the invention.

FIG. 6 is a schematic block diagram of a lithography system 600 that embodies the invention. The lithography system 600 includes a plasma source, such as the plasma source 500 of FIGS. 5A and 5B. The lithography system 600 also includes at least one light collection optic 608 that collects light 604 emitted by the plasma source 500. By way of example, the light 604 is emitted by a localized high intensity zone in the plasma of the plasma source 500. In one embodiment, the light 604 produced by the plasma source 500 is light having a wavelength shorter than about 15 nm for processing a semiconductor wafer 636. The light collection optic 608 collects the light 604 and directs collected light 624 to at least one light condenser optic 612. In this embodiment, the light condenser optic 624 condenses (i.e., focuses) the light 624 and directs condensed light 628 towards mirror 616*a* (generally 616) which directs reflected light 632*a* towards mirror 616*b* which, in turn, directs reflected light 632*b* towards a reflective lithographic mask 620. Light reflecting off the lithographic mask 620 (illustrated as the light 640, 640' and 640") is directed to the semiconductor wafer 636 to, for example, produce at least a portion of a circuit image on the wafer 636. Mirror 650 reflects light 640 producing light 640'. Mirror 650' reflects light 640' producing 640". In this embodiment, mirrors 650 and 650' (generally 650) cooperate to focus the light between the lithographic mask 620 and the wafer 636 by a factor of 4× reduction. Alternative numbers of optical components (e.g., mirrors 650 and lenses) can be used with alternative reduction factors. Alternatively, the lithographic mask 620 can be a transmissive lithographic mask in which the light 632*b*, instead, passes through the lithographic mask 620 and produces a circuit image on the wafer 636.

In an exemplary embodiment, a lithography system, such as the lithography system 600 of FIG. 6 produces a circuit image on the surface of the semiconductor wafer 636. The plasma source 500 produces plasma at a pulse rate of about 10,000 pulses per second. The plasma has a localized high intensity zone that is a point source of pulses of high intensity light 604 having a wavelength shorter than about 15 nm. Collection optic 608 collects the light 604 emitted by the plasma source 500. The collection optic 608 directs the collected light 624 to light condenser optic 612. The light condenser optic 612 condenses (i.e., focuses) the light 624 and directs condensed light 628 towards mirror 616*a* (generally 616) which directs reflected light 632*a* towards mirror 616*b* which, in turn, directs reflected light 632*b* towards a reflective lithographic mask 620. The mirrors 616*a* and 616*b* are multilayer optical elements that reflect wavelengths of light in a narrow wavelength band (e.g., between about 5 nm and about 20 nm). The mirrors 616*a* and 616*b*, therefore, transmit light in that narrow band (e.g., light having a low infrared light content).

Figure 7:
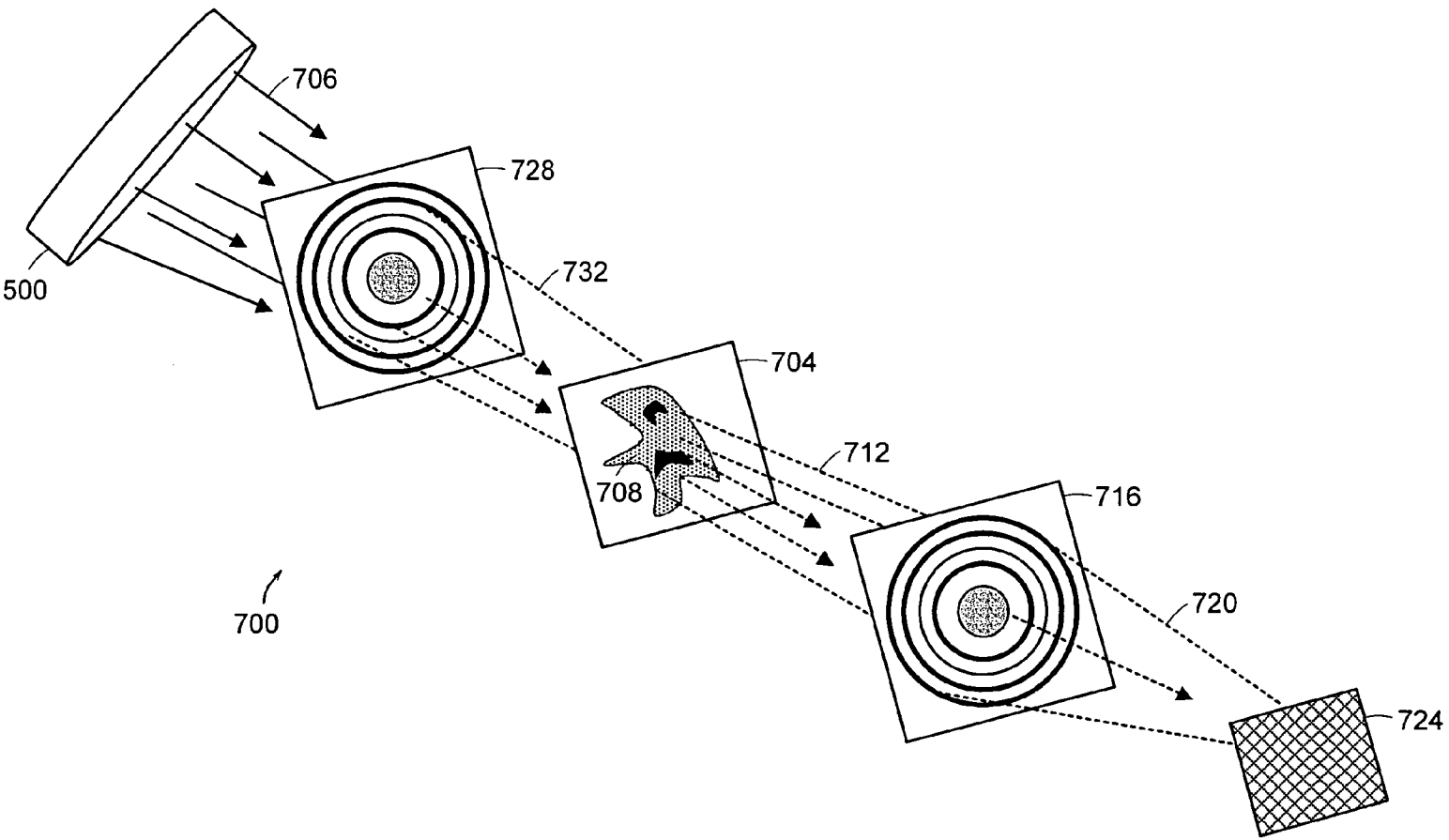
FIG. 7 is a schematic block diagram of a microscopy system, according to an illustrative embodiment of the invention.

FIG. 7 is a schematic block diagram of a microscopy system 700 (e.g., a soft X-ray microscopy system) that embodies the invention. The microscopy system 700 includes a plasma source, such as the plasma source 500 of FIGS. 5A and 5B. The microscopy system 700 also includes a first optical element 728 for collecting light 706 emitted from a localized high intensity zone of a plasma, such as the plasma 508 of the plasma source of FIG. 5. In one embodiment, the light 706 emitted by the plasma source 500 is light having a wavelength shorter than about 5 nm for conducting X-ray microscopy. The light 706 collected by the first optical element 728 is then directed as light signal 732 towards a sample 708 (e.g., a biological sample) located on a substrate 704. Light 712 which passes through the sample 708 and the substrate 704 then passes through a second optical element 716. Light 720 passing through the second optical element (e.g., an image of the sample 728) is then directed onto an electromagnetic signal detector 724 imaging the sample 728.

Figure 8A:
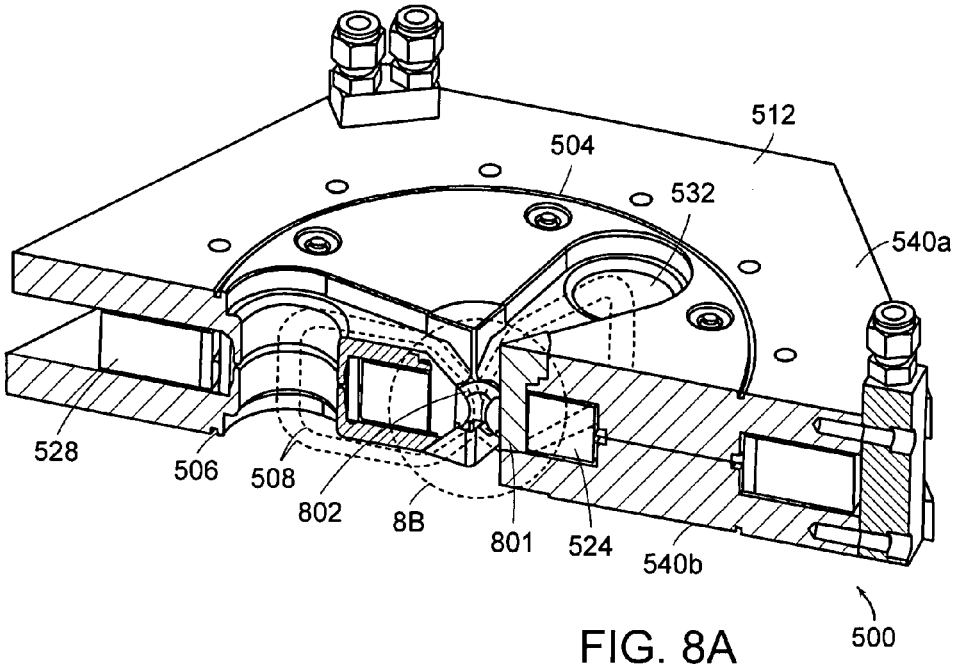
FIG. 8A is a cutaway view of an isometric view of a plasma source illustrating the placement of an insert, according to an illustrative embodiment of the invention.
Figure 8B:
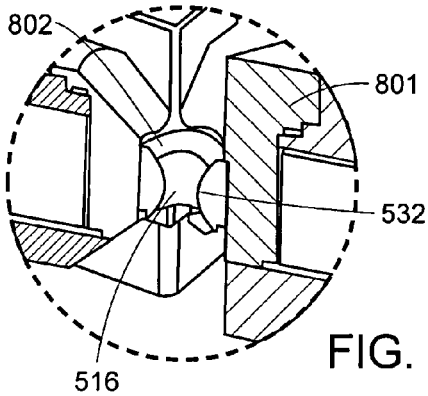
FIG. 8B is a blow-up of a region of FIG. 8A.

FIGS. 8A and 8B are cutaway views of another embodiment of an enclosure 512 of a plasma source 500. In this embodiment, the hole 516 is defined by a receptacle 801 and an insert 802. The receptacle 801 can be an integral part of the enclosure 512 or a separate part of the enclosure 512. In another embodiment, the receptacle 801 can be a region of the enclosure 512 that couples to the insert 802 (e.g., by a slip fit, threads, friction fit, or interference fit). In any of these embodiments, thermal expansion of the insert results in a good thermal and electrical contact between the insert and the receptacle.

In other embodiments, an outer surface of the insert 802 is directly connected to the plasma source 500. In other embodiments, the outer surface of the insert 802 is indirectly connected to the plasma source 500. In other embodiments, the outer surface of the insert 802 is in physical contact with the plasma source 500.

Figure 9A:
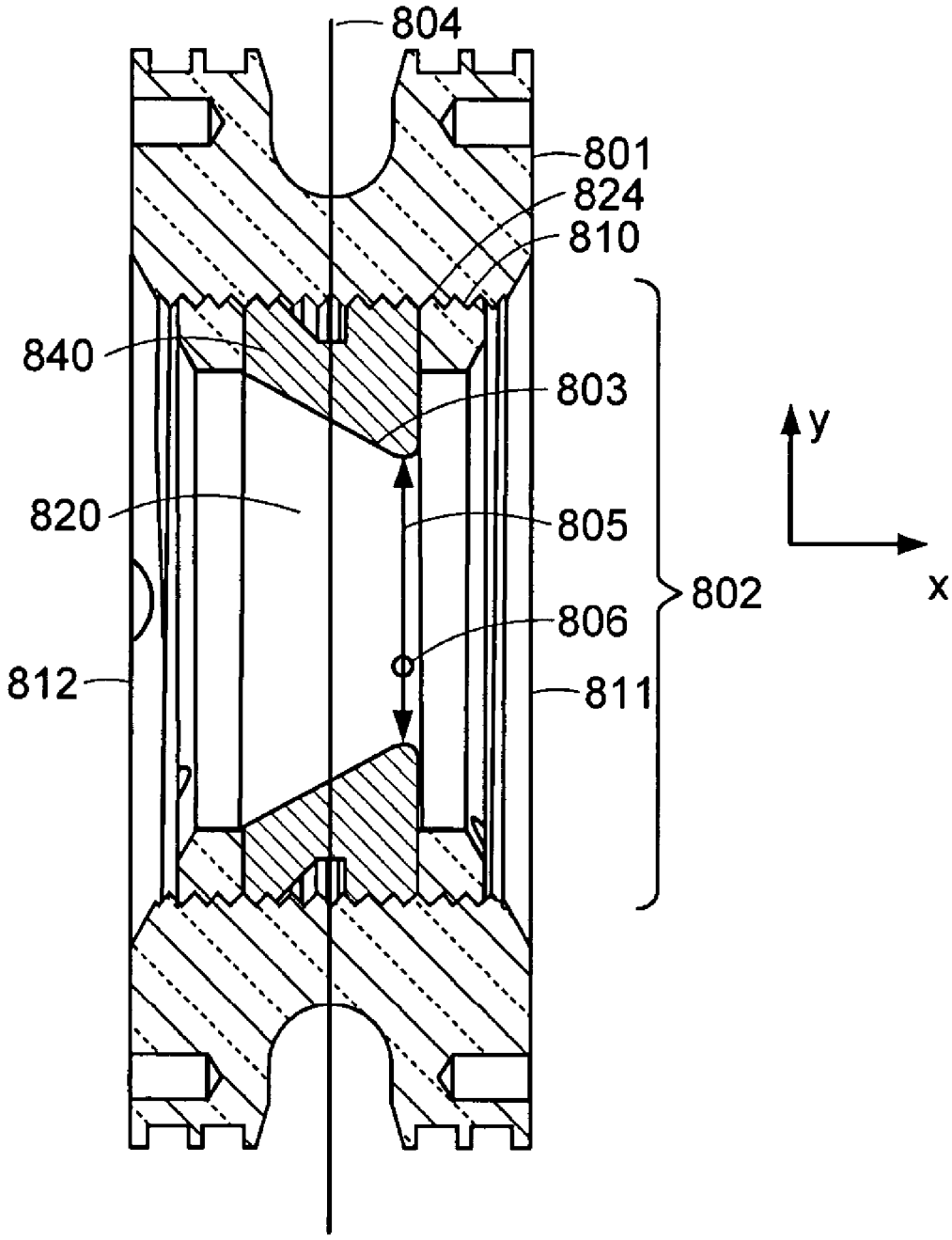
FIG. 9A is a cross-sectional view of an insert having an asymmetric inner geometry, according to an illustrative embodiment of the invention.

FIG. 9A is a cross section view of one embodiment of an insert 802 and the receptacle 801 in an enclosure (e.g., the enclosure 512 of FIG. 8A). The insert 802 has a body 840 that has a first open end 811 and a second open end 812. The plasma loops 508 enter the first open end 811, pass through an interior passage 820 of the insert 802, and exit the second open end 812. The interior passage 820 of the body 840 of the insert 802 defines a necked region 805. The necked region 805 is the region that defines a reduced dimension of the interior passage 820 along the length of the passage 820 between the first open end 811 and second open end 812 of the insert 802. The energy intensity is increased in the plasma loops 508 in the necked region 805 forming a localized high intensity zone.

In this embodiment, the insert 802 has threads 810 on an outer surface 824 of the insert 802. The receptacle 801 has a corresponding set of threads 810 to mate with the threads 810 of the insert 802. The insert 802 is inserted into the receptacle 801 by rotating the insert 802 relative to the receptacle 801, thereby mating the threads 810 of the insert 802 and the receptacle 801. In other embodiments, neither the insert 802 nor the receptacle 801 have threads 810 and the insert 802 can be slip fit into the receptacle 801 using a groove and key mechanism (not shown). The heat from the plasma causes the insert 802 to expand and hold it firmly in place within the receptacle 801. In this embodiment, the insert 802 is a unitary structure. In another embodiment, insert 802 can be defined by two or more bodies.

In this embodiment, the insert 802 defines a region that creates a high intensity zone in the plasma. The size of the high intensity zone, in part, determines the intensity of the plasma and the brightness of radiation emitted by the zone. The brightness of the high intensity zone can be increased by reducing its size (e.g. diameter or length). Generally, the minimum dimension of the necked region 805 along the passage 820 of the insert 802 determines the size of the high intensity zone. The local geometry of an inner surface 803 of the passage 820 in the insert 802 also determines the size of the high intensity zone. In some embodiments, the geometry of the inner surface 803 is asymmetric about a center line 804 of the insert 802, as shown in FIG. 9A.

The inner surface 803 of the insert 802 is exposed to the high intensity zone of the plasma. In some embodiments, the insert 802 is formed such that at least the inner surface 803 is made of a material with a low plasma sputter rate, allowing it to resist erosion by the plasma. For example, this can include materials like carbon, titanium, tungsten, diamond, graphite, silicon carbide, silicon, ruthenium, boron nitride or a refractory material. It is also understood that alloys or compounds including one or more of those materials can be used to form the insert 802 or coat the inner surface 803 of the insert 802.

In another embodiment, it is recognized that material from the inner surface 803 of the insert 802 interacts with the plasma (e.g., sputtered by the plasma) and is deposited on, for example, optical elements of a light source. In this case, it is desirable to form the insert such that at least the inner surface 803 comprises or is coated with a material which does not absorb the EUV light being emitted by the light source. For example, materials that do not absorb or absorb a minimal amount of the EUV radiation include ruthenium or silicon, or alloys or compounds of ruthenium or silicon. This way, material sputtered from the inner surface 803 of the insert 802 and deposited on, for example, the optical elements, does not substantially interfere with the functioning (e.g., transmission of EUV radiation) of the optical elements.

In this embodiment, the insert 802 is in thermal communication with the receptacle 801 in order to dissipate the heat from the plasma high intensity zone. In some embodiments, one or more cooling channels (not shown) can pass through the body 840 of the insert 802 to cool the insert 802. In some embodiments it is desirable to form the insert 802 such that at least the inner surface 803 is made of a material with a low plasma sputter rate and a high thermal conductivity. For example, this can include highly oriented pyrolytic graphite (HOPG) or thermal pyrolytic graphite (TPG). It is also understood that alloys or compounds with those materials can be used.

In this embodiment, the insert 802 includes a gas inlet 806 for, for example, introducing the ionizable medium into the chamber, as described previously herein.

Figure 9B:
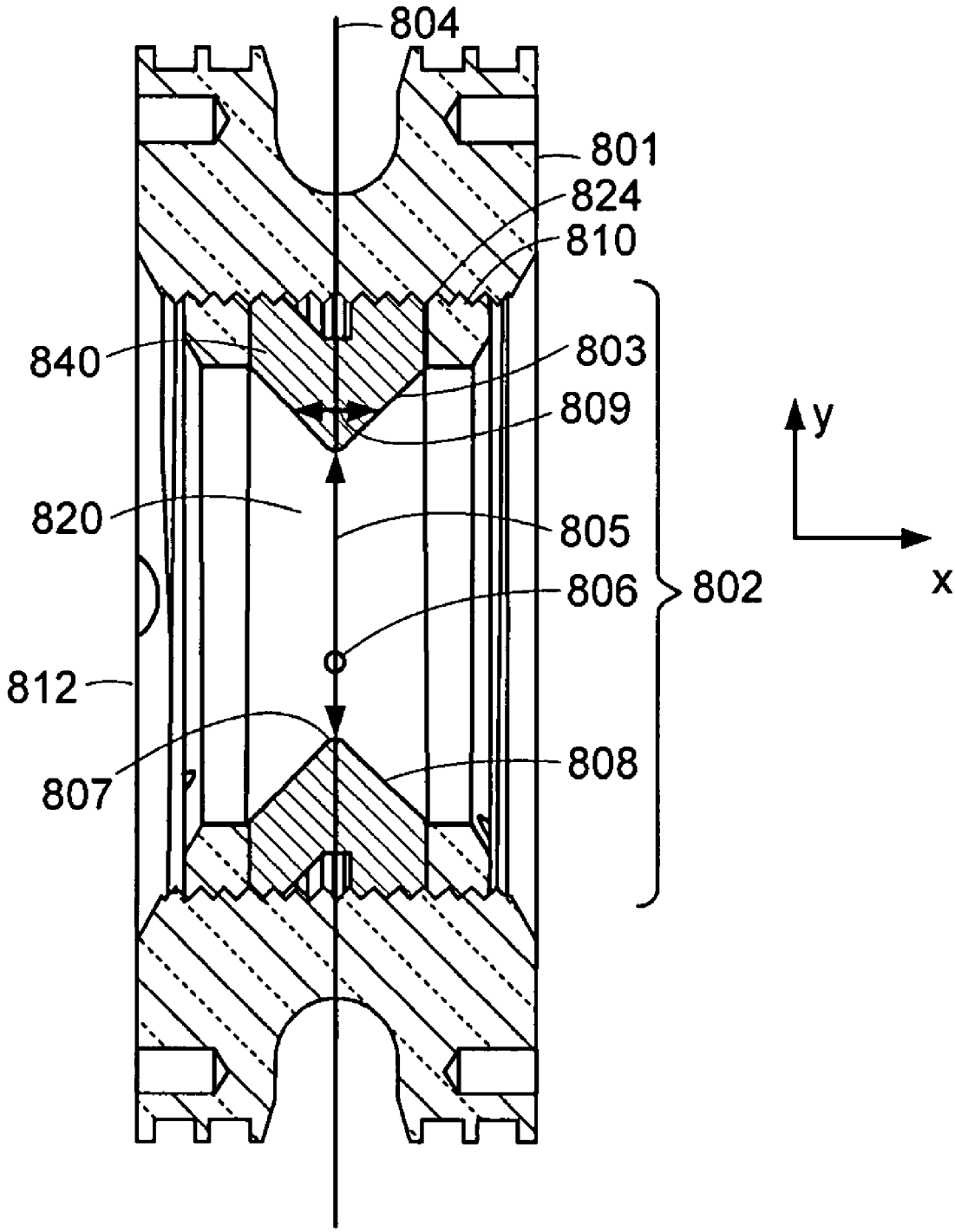
FIG. 9B is a cross-sectional view of an insert, according to an illustrative embodiment of the invention.

FIG. 9B illustrates another embodiment of an insert 802. In this embodiment, the geometry of the inner surface 803 is symmetric about a center line 804 of the insert 802. As stated earlier, the local geometry of the inner surface 803 of the interior passage 820 of the insert 802 determines the size of the high intensity zone. The size of the high intensity zone determines, in part, the brightness of the radiation emanating from the high intensity zone. Characteristics of the geometry of inner surface 803 factor into this determination. Characteristics include, but are not limited to, the following. The minimum dimension of the necked region 805 constrains the high intensity zone along the y-axis. The necked region 805 can be, but does not need to be, radially symmetric around the axis 813 of the insert 802. A length 809 of the necked region 805 also serves to constrain the high intensity zone. A slope of the sidewall 808 of the necked region 805 also determines the size of the high intensity zone. In addition, varying the radius of curvature 807 of the inner surface 803 changes the size of the high intensity zone. For example, as the radius of curvature 807 is decreased, the high intensity zone also decreases in size.

Figure 9C:
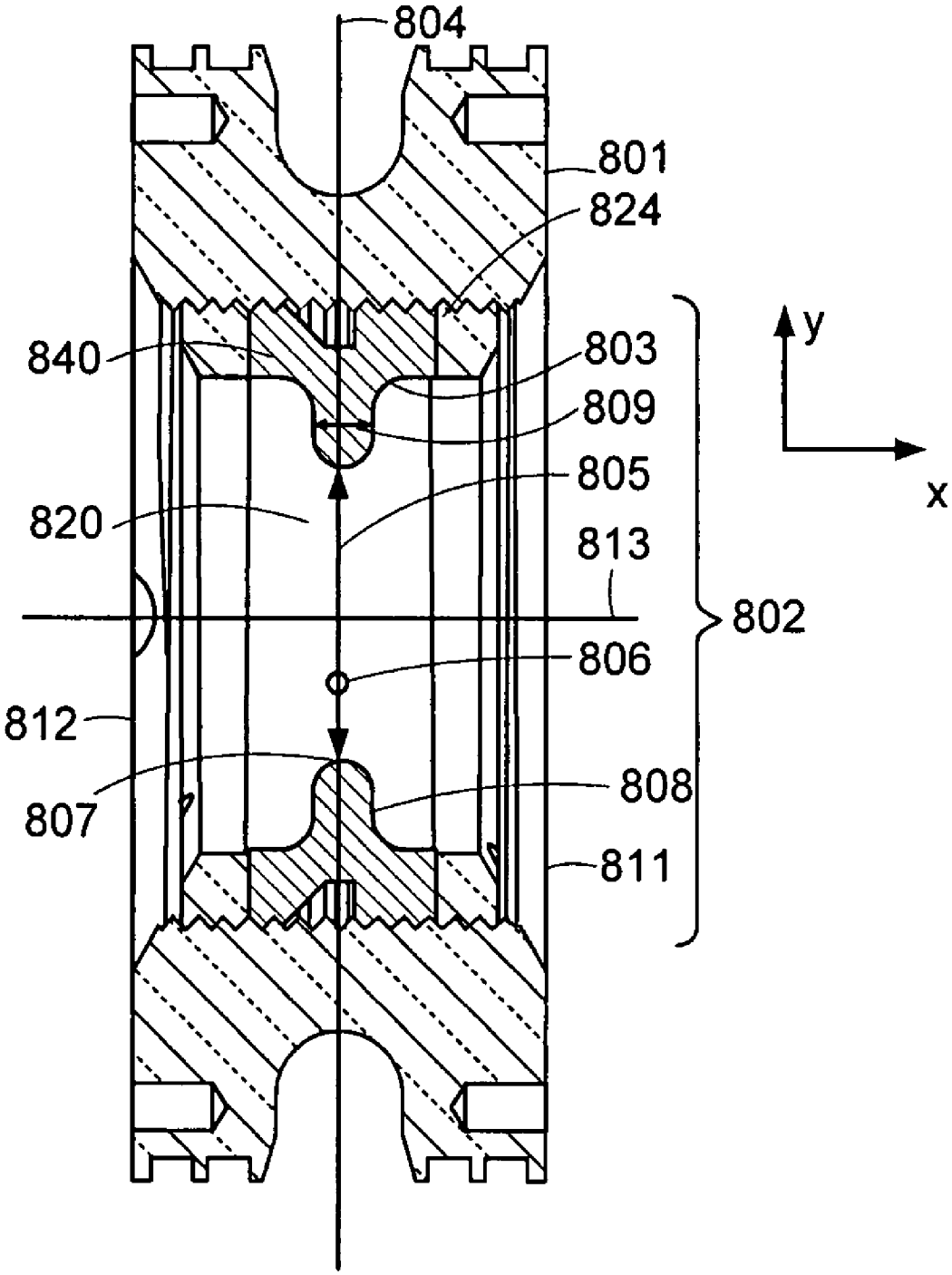
FIG. 9C is a cross-sectional view of an insert, according to an illustrative embodiment of the invention.

FIG. 9C illustrates another embodiment of the insert 802. In this embodiment, the slope of the sidewall 808 is vertical (perpendicular to the z-axis), making the length 809 of the necked region 805 uniform in the radial direction. Again, it is understood that the local geometry of the inner surface 803 of the insert 802 need not be radially symmetric around the axis 813 of the insert 802. In some embodiments, the local geometry shown in FIG. 9C that defines the inner surface 803 is a plurality of discrete posts positioned within the insert 802 along the inner surface 803 of the insert 802.

Other shapes, sizes and features are contemplated for the local geometry of the inner surface 803 of the insert 802. Portions of the inner surface 803 can be concave or convex, while still having a radius 807 that defines the high intensity zone. The slope of the sidewall 808 of the necked region 805 can be positive, negative, or zero. The local geometry of the inner surface 803 can be radially symmetric about the axis 813 of the insert 802 or not. The local geometry of the inner surface 803 of the insert 802 can be symmetric about the center line 804 or not.

In some embodiments, applications using a plasma source (e.g., the plasma source 100 of FIG. 1 include an enclosure (e.g., the enclosure 512 of FIG. 8A) that includes an insert (e.g., the insert 802 of FIG. 9A). In these applications, the insert 802 is a consumable component of the plasma source 100 that can be removed or replaced by an operator. In some embodiments, the insert 802 can be replaced using a robotic arm (not shown) that engages or interfaces with the insert 802. In this manner, the robotic arm can remove an insert 802 and replace it with a new insert 802. It may be desirable to replace inserts 802 that have become worn or damaged during operation of the plasma source.

By way of example, a coating of material (e.g. ruthenium) on the inner surface 803 of the insert 802 may erode or be sputtered as plasma loops 508 pass through the interior passage 820 of the insert 802. In some embodiments, as the inner surface 803 of the insert 802 is eroded or sputtered by the plasma loops 508, its ability to define the localized high intensity zone can be compromised. A new insert 802 can be placed into a chamber 104 of the plasma source 100 through a vacuum load lock (not shown) installed in the chamber 104. After the new insert 802 is placed in the chamber 104, the robotic arm can be used to install the new insert 802 into the receptacle 801 of the enclosure 512. For example, if the receptacle 801 and the insert 802 have mating threads 810, the robotic arm can rotate the insert 802 relative to the receptacle 801 to install the insert 802 by mating the matching threads 810. In this manner, by robotically replacing the insert 802, uptime of the plasma source is improved. Robotically replacing the insert 802 while maintaining a vacuum in the chamber 104, further improves uptime of the plasma source.

Figure 10:
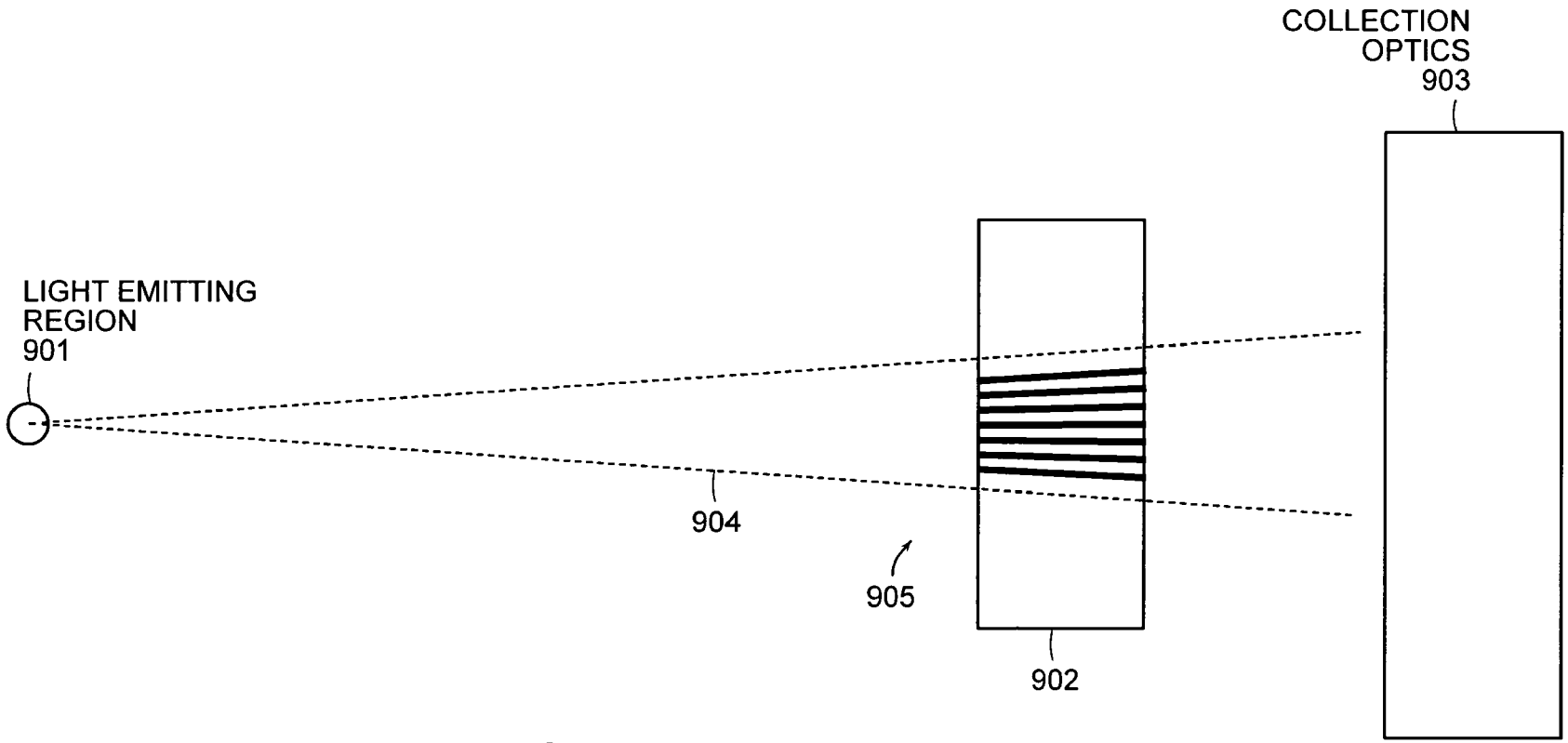
FIG. 10 is a schematic diagram of the placement of a filter, according to an illustrative embodiment of the invention.

FIG. 10 is a schematic diagram of a filter 902 used in conjunction with a plasma source (not shown). The plasma source has a light emitting region 901 (e.g., the localized high intensity zone of the plasma source 500 of FIGS. 5A and 5B). The filter 902 is disposed relative to the light emitting region 901 to reduce emissions from the light emitting region 901 and from other locations in the plasma source. Emissions include, but are not limited to, particles sputtered from surfaces within the plasma source, ions, atoms, molecules, charged particles, and radiation. In this embodiment, the filter 902 is positioned between the light emitting region 901 and, for example, collection optics 903 of a lithography system (e.g., the lithography system 600 of FIG. 6). The role of the filter 902 is to allow radiation from the light emitting region 901 to reach the collection optics 903, but not allow (or reduce), for example, particles, charged particles, ions, molecules or atoms to reach the collection optics 903.

The filter 902 is configured to minimize the reduction of emissions traveling substantially parallel to the direction of radiation 904 emanating from the light emitting region 901. The filter 902 is also configured to trap emissions which are traveling in directions substantially not parallel 905 (e.g., in some cases orthogonal) to the direction of radiation 904 emanating from the light emitting region 901. The particles, charged particles, ions, molecules and atoms which are not traveling substantially parallel to the direction of radiation 904 emanating from the light emitting region 901 collide with the filter 902 and cannot reach, for example, the collection optics 903. The particles, charged particles, ions, molecules and atoms which are initially traveling substantially parallel to the direction of radiation 904 emanating from the light emitting region 901 undergo collisions with gas atoms, ions or molecules and be deflected so that they begin to travel in a non-parallel direction thereby becoming trapped at the filter. In some embodiments, the filter 902 is capable of substantially reducing the number of particles, charged particles, ions, molecules and atoms which reach, for example, collection optics 903, while not substantially reducing the amount of radiation which reaches, for example, the collection optics 903.

Figure 11A:
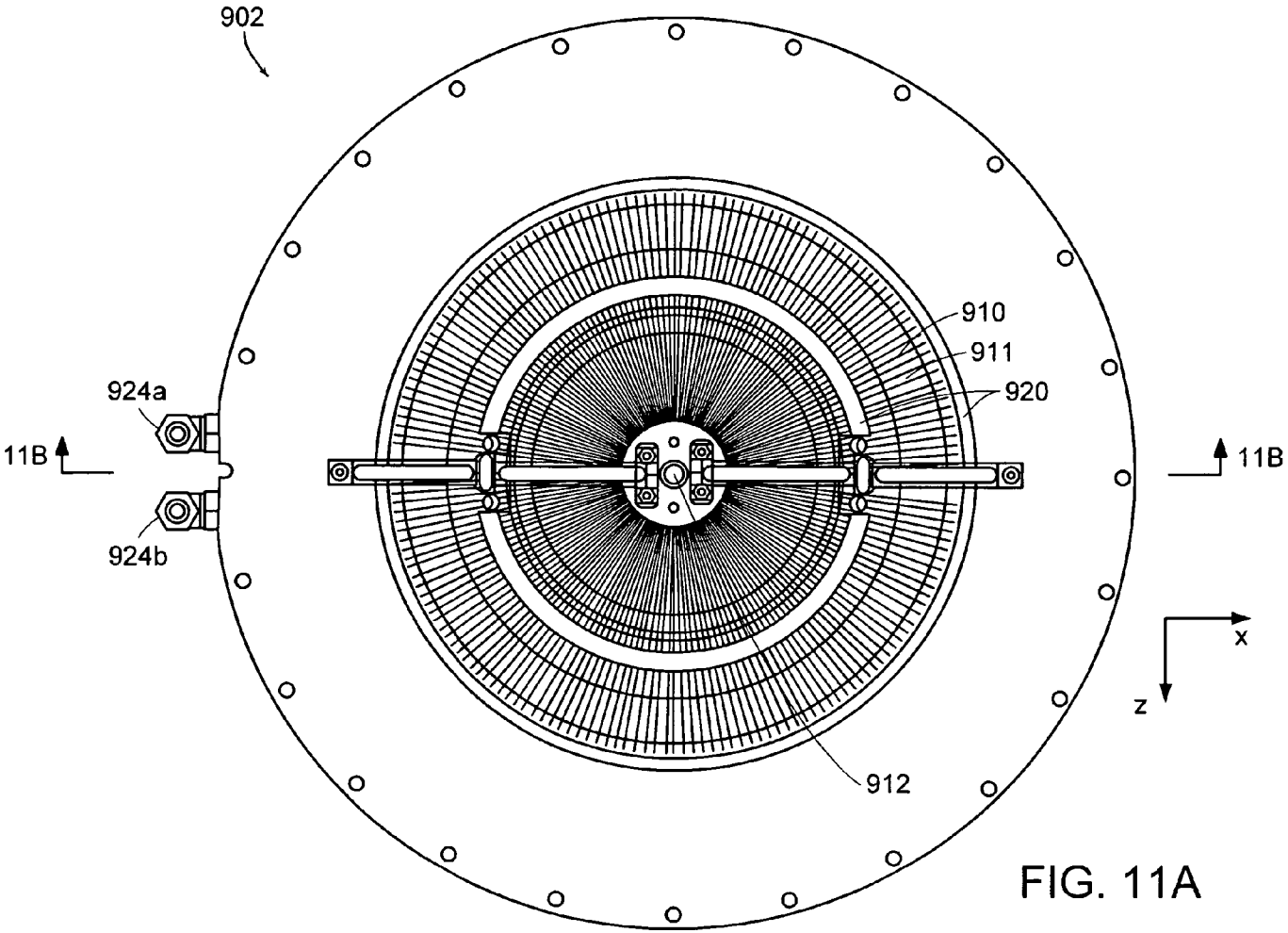
FIG. 11A is a schematic view of a filter, according to an illustrative embodiment of the invention.
Figure 11B:
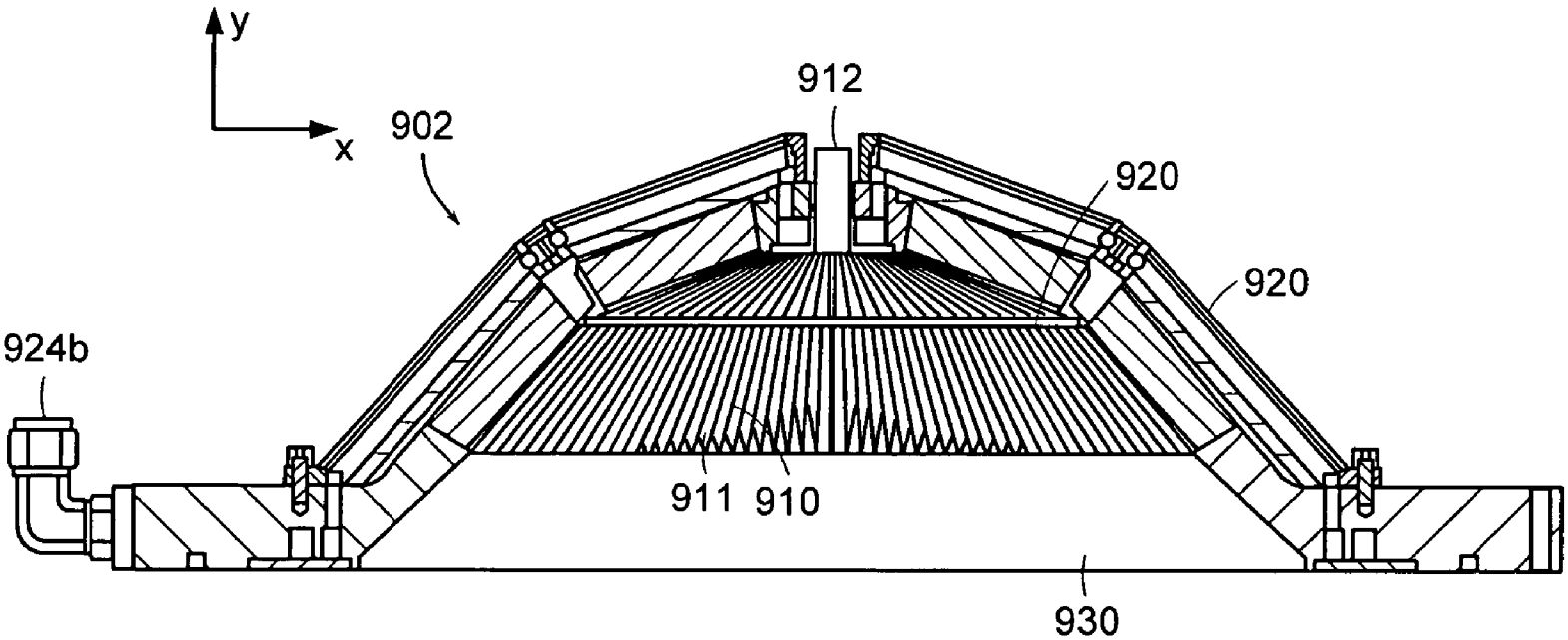
FIG. 11B is a cross-sectional view of the filter of FIG. 11A.

FIGS. 11A and 11B illustrate one embodiment of a filter 902. The filter 902 comprises a plurality of thin walls 910 with narrow channels 911 between the walls 910. In this embodiment, the walls 910 are arranged radially around the center 912 of the filter 902. In some embodiments, the walls 910 are formed such that at least the surfaces of the walls exposed to the emissions (surfaces within the channels 911) comprise or are coated with a material which has a low plasma sputter rate. For example, this can include materials like carbon, titanium, tungsten, diamond, graphite, silicon carbide, silicon, ruthenium, or a refractory material. In this embodiment, radiation from a light emitting region (e.g., the light emitting region 901 of FIG. 10) is directed toward an inside region 930 of the filter 902 along the positive direction of the y-axis.

In this embodiment, the filter 902 includes at least one cooling channel 920. The walls 910 are in thermal communication with the at least one cooling channel 920. The filter 902 includes an inlet 924*a* and an outlet 924*b* for flowing coolant through the channel 920. The cooling channel 920 dissipates heat associated with, for example, particles, charged particles, ions, molecules or atoms impacting the walls 910. In some embodiments, the walls 910 are formed such that at least the surfaces of the walls exposed to the emissions are made from a material which has a low plasma sputter rate and a high thermal conductivity. For example, this can include materials like highly oriented pyrolytic graphite or thermal pyrolytic graphite. In some embodiments, multiple cooling channels 920 are provided to cool the filter 902 due to exposure of the filter 902 to particles, charged particles, ions, molecules and atoms. Cooling the filter 902 keeps it at a temperature which will not compromise the structural integrity of the filter 902 and also prevent excessive thermal radiation from the filter 902.

In another embodiment, a curtain of buffer gas is maintained in the vicinity of the filter 902. This buffer gas can be inert and have a low absorption of EUV radiation (e.g., helium or argon). Emissions such as particles, charged particles, ions, molecules and atoms which are initially traveling in a direction substantially parallel to the direction of radiation (e.g., the direction of radiation 904 of FIG. 10) emanating from the light emitting region 901 collide with gas molecules. After colliding with the gas molecules, the particles, charged particles, ions, molecules and atoms travel in directions substantially not parallel 905 to the direction of radiation 904 emanating from the light emitting region 901. The particles, charged particles, ions, molecules and atoms then collide with the walls 910 of the filter 902 and are trapped by the surfaces of the walls 910. The radiation emanating from the light emitting region 901 is not affected by the gas molecules and passes through the channels 911 between the walls 910.

In other embodiments (not shown) the walls 910 are configured to be substantially parallel to each other to form a Venetian blind-like structure (as presented to the light emitting region 901). In other embodiments (not shown), the walls 910 can be curved to form concentric cylinders (with an open end of the cylinders facing the light emitting region 901). In other embodiments, the walls can be curved into individual cylinders and placed in a honeycomb pattern (as presented to the light emitting region 901).

Figure 12B:
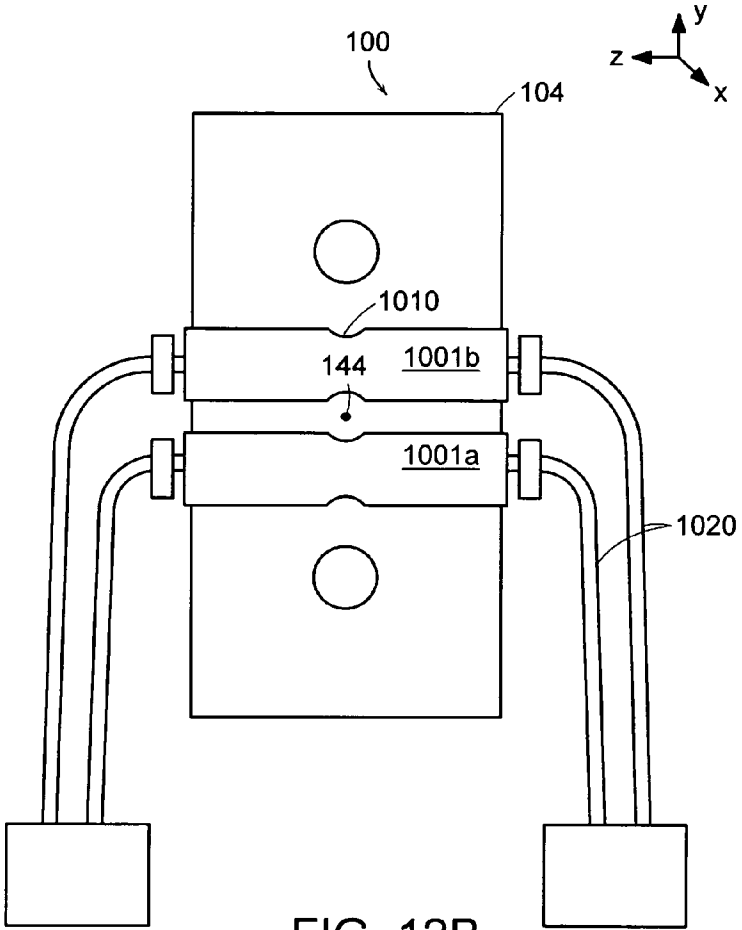
FIG. 12B is a schematic end-view of the system of FIG. 12A.
Figure 12A:
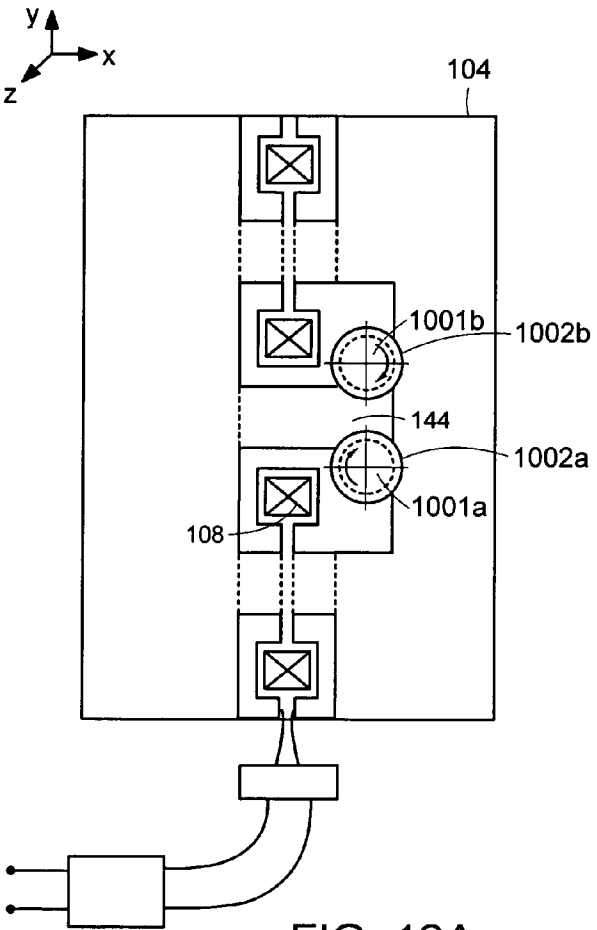
FIG. 12A is a schematic side view of a system for spreading heat and ion flux from a plasma over a large surface area, according to an illustrative embodiment of the invention.

Another embodiment of a plasma source chamber 104 is shown in FIGS. 12A and 12B. In this embodiment, objects 1001*a* and 1001*b* (generally 1001) are disposed near a high intensity zone 144 of a plasma. Surfaces 1002*a* and 1002*b* (generally 1002) of the objects 1001*a* and 1001*b*, respectively, are moving with respect to the plasma. The moving surfaces 1002 act to spread the heat flux and ion flux associated with the plasma over a large surface area of the surfaces 1002 of the objects 1001. In this embodiment, the objects 1001 are two rods. The rods 1001 are spaced closely together along the y-axis near the plasma discharge region and have a local geometry 1010 that defines the localized high intensity zone 144. By using multiple objects 1001 spaced closely together along with a local geometry 1010 in at least one object 1001, the high intensity zone is constrained in two dimensions.

In some embodiments, however, a single object 1001 is used to spread the heat flux and ion flux associated with the plasma and to define the localized high intensity zone relative to another structure. It is understood that various alternate sizes, shapes and quantities of objects 1001 can be used.

In this embodiment, at least one object 1001 is in thermal communication with cooling channels 1020. Coolant flows through the channels 1020 to enable the surfaces 1002 of the objects 1001 to dissipate the heat from the plasma. By moving the surface 1002 of the objects 1001 with respect to the plasma (e.g., rotating the rods 1001 around the z-axis), the plasma is constantly presented with a newly cooled portion of the surface 1002 for dissipating heat. In another embodiment, the surface 1002 of the at least one object 1001 is covered with a sacrificial layer. This allows ion flux and heat flux from the plasma to erode the sacrificial layer of the surface 1002 of the at least one object 1001 without damaging the underlying object 1001. By moving the surface 1002 with respect to the plasma, the plasma is presented with a fresh surface to dissipate the ion flux and heat flux. Plasma ions collide with the surface 1002 of the at least one object 1001. These collisions result in, for example, the scattering of particles, charged particles, ions, molecules and atoms from the surface 1002 of the at least one object 1001. In this manner, the resulting particles, charged particles, ions, molecules and atoms are most likely not traveling towards, for example, the collection optics (not shown). In this way, the at least one object 1001 has prevented the ion flux from the plasma from interacting with, for example, collection optics (not shown).

In one embodiment, the surface 1002 of the at least one object 1001 is continuously coated with the sacrificial layer. This can be accomplished by providing solid material (not shown) to the at least one object 1001 being heated by the plasma. Heat from the plasma melts the solid material allowing it to coat the surface 1002 of the at least one object 1001. In another embodiment, molten material can be supplied to the surface 1002 of the at least one object 1001 using a wick. In another embodiment, part of the surface 1002 of the at least one object 1001 can rest in a bath of molten material, which adheres to the surface 1002 as it moves (e.g., rotates). In another embodiment, the material can be deposited on the surface 1002 of the at least one object 1001 from the gas phase, using any of a number of well known gas phase deposition techniques. By continuously coating the surface 1002 of the at least one object 1001, the sacrificial layer is constantly replenished and the plasma is continuously presented with a fresh surface 1002 to dissipate the ion flux and heat flux, without harming the underlying at least one object 1001.

In another embodiment, at least the surface 1002 of the at least one object 1001 can be made from a material which is capable of emitting EUV radiation (e.g., lithium or tin). Plasma ions colliding with the surface 1002 cause atoms and ions of that material to be emitted from the surface 1002 into the plasma, where the atoms and ions can emit EUV radiation, increasing the radiation produced by the plasma.

Figure 13:
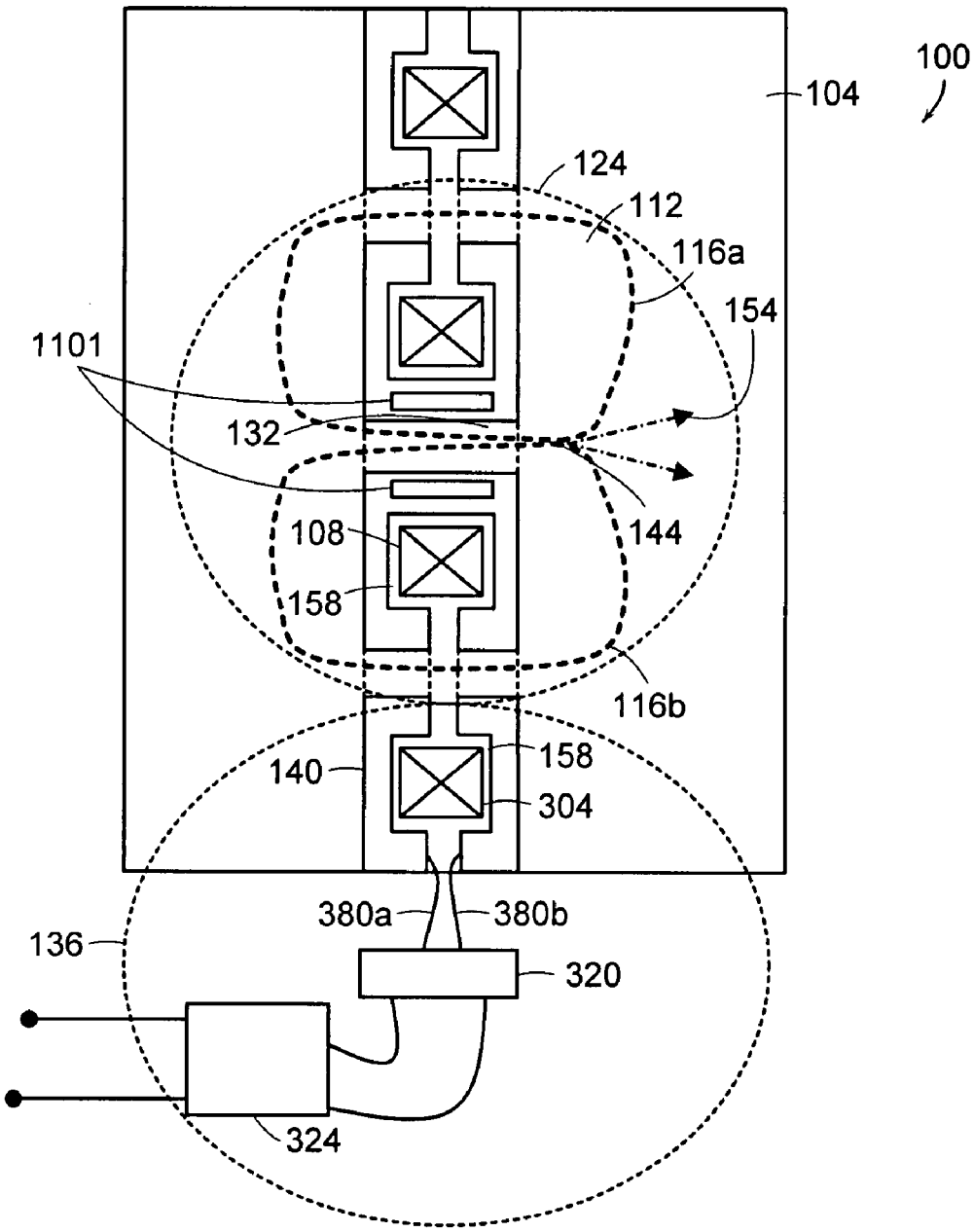
FIG. 13 is a cross-sectional diagram of a plasma chamber, showing placement of magnets to create a high intensity zone, according to an illustrative embodiment of the invention.

FIG. 13 is a cross-sectional view of another embodiment of the plasma source chamber 104. In this embodiment, one or more magnets (generally 1101) are disposed near the high intensity zone 144 of the plasma. The at least one magnet 1101 can be either a permanent magnet or an electromagnet. By placing at least one magnet 1101 in the plasma chamber 104, the magnetic field generated by the at least one magnet 1101 defines a region to create a localized high intensity zone 144. It is understood that a variety of configurations and placements of magnets 1101 are possible. In this embodiment, the magnets 1101 are located within the channel 132 in the plasma discharge region 112. In another embodiment, one or more magnets 1101 can be located adjacent to, but outside of the channel 132. In this manner, using a magnetic field, rather than a physical object (e.g., the objects 1001 of FIGS. 12A and 12B and the disk 308 of FIGS. 3A and 3B) to define a region to create a localized high intensity zone 144 in the plasma reduces the flux of particles, charged particles, ions, molecules and atoms that result from collisions between the plasma ion flux and the physical object.

Figure 14B:
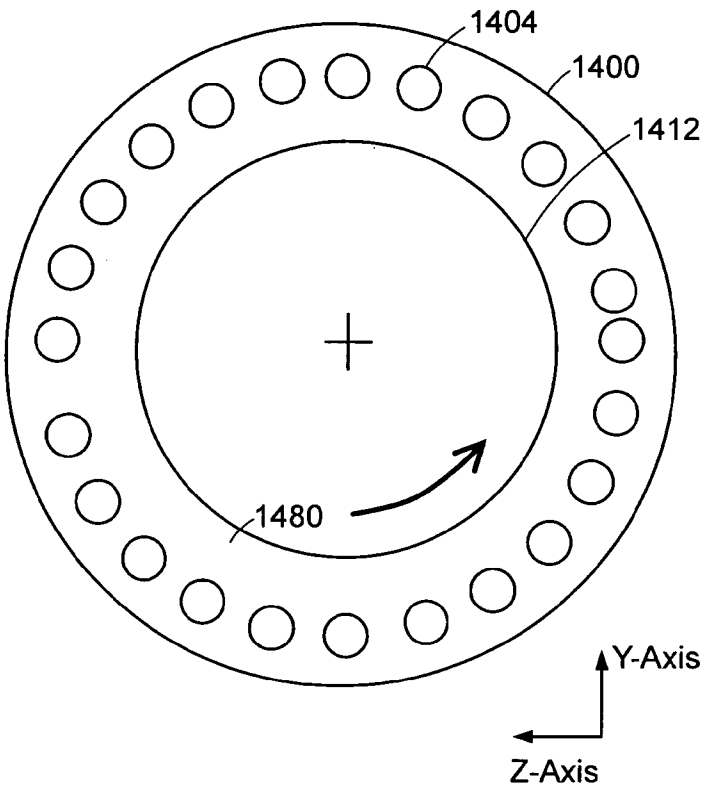
FIG. 14B is an end view of the rotating disk of FIG. 14A.
Figure 14A:
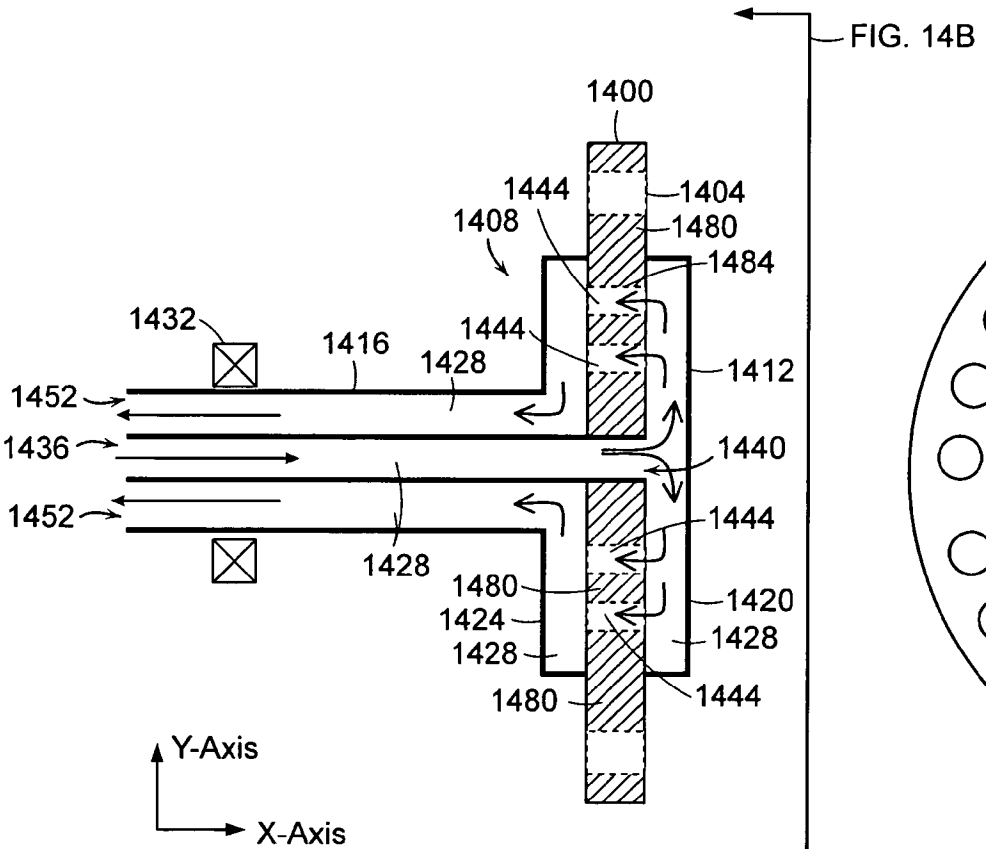
FIG. 14A is a schematic view of a rotating disk, according to an illustrative embodiment of the invention.

FIGS. 14A and 14B are schematic views of a rotating disk 1400, according to an illustrative embodiment of the invention. The rotating disk 1400 can be used in a plasma source, for example, the plasma source 100 of FIGS. 3A and 3B and the plasma source 500 of FIGS. 5A and 5B and FIGS. 8A and 8B. The rotating disk 1400 of FIG. 14A can be used in the plasma source 100 in place of disk 300 of FIG. 3A. The disk 1400 creates a localized high intensity zone in plasma loops, for example, the localized high intensity zone 144 of FIG. 3A.

The disk 1400 has a plurality of apertures 1404 that are located equally angularly spaced around the disk 1400 when viewed in the Y-Z plane (see FIG. 14B). The disk 1400 can be rotated around the X-axis such that the channel 132 of FIG. 3A may be alternately uncovered when aligned with an aperture 1404 of FIG. 14A and covered when not aligned with an aperture 1404. The disk 1400 is configured to pinch plasma loops (i.e., decrease the cross-sectional area of plasma loops) in the apertures 1404, similarly as described herein.

The disk 1400 also has a coolant system 1408 for carrying coolant to the disk 1400. The disk 1400 has a bottom plate 1424 and a cover plate 1420 that are coupled to the disk 1400 to define an interior region 1428 through which the coolant flows. A rotating shaft 1416 is coupled to the bottom plate 1424. Rotation of the shaft 1416 around the X-axis causes the bottom plate 1424 to rotate around the X-axis, thereby causing the disk 1400 to also rotate around the X-axis. Various drive systems can be used to rotate the shaft 1416. In one embodiment, a rotary drive is provided to the shaft 1416 by a rotary drive system of a tool or piece of equipment (e.g., lithography tool) that incorporates the plasma source. In some embodiments, an encoder is coupled to the rotary drive. Signals from the encoder can be provided to a control system to control, for example, the rotation of the disk 1400 and/or pulse of energy delivered to the magnetic core based on the signals from the encoder.

A rotating vacuum seal 1432 is disposed around the shaft 1416 to maintain a sealed chamber (e.g., the chamber 104 of FIG. 3A) during rotation of the shaft 1416. In one embodiment, the seal 1432 is a rotating ferrofluidic seal capable of operating at speeds of rotation greater than 20,000 RPM. The rotating ferrofluidic seal uses ferrofluidic materials to create a fluid seal around the rotating shaft. Ferrofluidic seals offered for sale by Ferrotec Corporation (Nashua, N.H.) can be used as the seal 1432.

Coolant is supplied to the system via a coolant inlet 1436 and travels within the interior region 1428 of the shaft 1416 along the positive direction of the X-axis. The coolant then flows out of an opening 1440 located inside the shaft 1416 and radially outward when viewed in the Y-Z plane. The coolant then flows along the negative direction of the X-axis through a plurality of coolant apertures 1444 located in the disk 1400. The coolant then flows along an outer circumferential passage 1448 of the shaft 1416 and out a coolant outlet 1452 to be, for example, recovered or recycled.

Heat generated in the apertures 1404 of the disk 1400 during operation of the plasma source is conducted by the body 1480 of the disk 1400. The body 1480 of the disk conducts heat to walls 1484 of the coolant apertures 1444 where, by conduction, the heat is absorbed by the coolant flowing through the coolant apertures 1444. Generally, the coolant flowing through the system is a fluid having good thermal conduction properties. In one embodiment, the coolant is water (e.g., de-ionized water).

In some embodiments, inserts are located in the apertures 1404, for example, one or more of the inserts of FIG. 9A, 9B or 9C.

Figure 15:
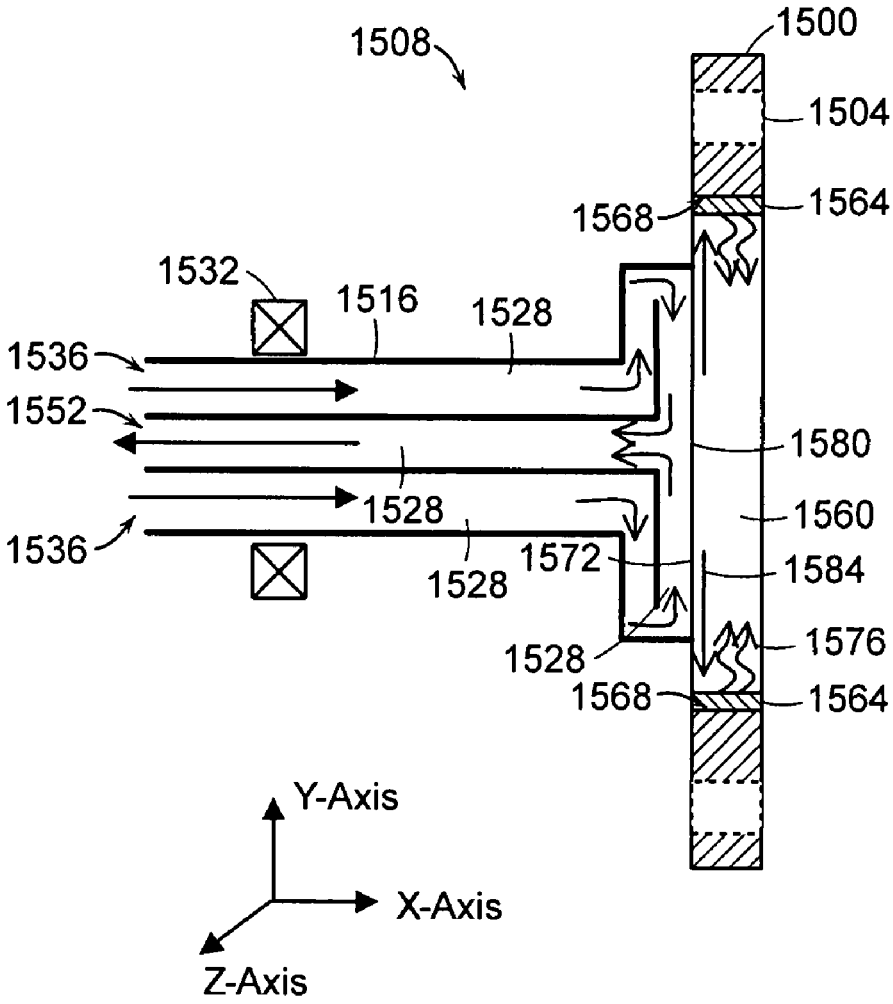
FIG. 15 is a schematic view of a rotating disk, according to an illustrative embodiment of the invention.

FIG. 15 is a schematic illustration of a disk 1500 and coolant system 1508, according to an illustrative embodiment of the invention. The disk has a plurality of apertures 1504 that are located equally angularly spaced around the disk 1500 when viewed in the Y-Z plane. The disk 1500 creates a localized high intensity zone in plasma loops, for example, the localized high intensity zone 144 of FIG. 3A. The disk 1500 is configured to pinch plasma loops (i.e., decrease the cross-sectional area of plasma loops) in the apertures 1504, similarly as described herein.

The coolant system 1508 in conjunction with the disk 1500 operates based on heat-pipe principles. The disk 1500 has a chamber 1560 that contains a small amount of fluid 1564 (e.g., water). A rotating shaft 1516 is coupled to the disk 1500. Rotation of the shaft 1516 around the X-axis causes the disk 1500 to rotate around the X-axis. When the disk 1500 rotates around the X-axis, the fluid 1564 is directed radially outward and into contact with a surface 1568 within the chamber 1560. Various drive systems can be used to rotate the shaft 1516. In one embodiment, a rotary drive is provided to the shaft 1516 by a rotary drive system of a tool or piece of equipment (e.g., lithography tool) that incorporates the plasma source. A rotating vacuum seal 1532 is disposed around the shaft 1516 to maintain a sealed chamber (e.g., the chamber 104 of FIG. 3A) during rotation of the shaft 1516. In one embodiment, the seal 1532 is a rotating ferrofluidic seal capable of operating at speeds of rotation greater than 20,000 RPM.

Coolant is supplied to the system 1508 via a coolant inlet 1536 and travels within the interior region 1528 along the positive direction of the X-axis. The coolant then flows along a surface 1572 within the interior region 1528 of the coolant system 1508. The surface 1572 is adjacent an inner surface 1580 of the chamber 1560 of the disk 1500. The coolant then flows along the negative direction of the X-axis and out of the system 1508 via a coolant outlet 1552 to be, for example, recovered or recycled. In some embodiments, the shaft 1516 has an air vent to allow for leakage of air out of the interior region of the shaft 1716.

During operation, the disk 1500 conducts heat away from the apertures 1504 and radially inward towards the surface 1568 where the heat causes the fluid 1564 to evaporate, generating a vapor 1576. The vapor 1576 then contacts the inner surface 1580 of the chamber 1560. When the vapor 1576 contacts the inner surface 1580 of the chamber 1560, the vapor 1576 transfers energy to the coolant located in the region 1528 of the coolant system 1508. The vapor 1576 then condenses back into a fluid state 1584 and is directed back, radially outward toward the surface 1568 by centrifugal force associated with the rotation of the shaft 1516 and disk 1500. In this manner, heat can be dissipated without requiring the chamber 1560 of the disk 1500 to be filled with a coolant fluid. This allows for the disk 1500 to be lighter because the disk 1500 has a chamber 1560 which does not require the chamber to be filled with a coolant fluid.

In one embodiment, during operation the rotation of the disk 1500 generates centrifugal loads on the fluid 1564 (e.g., water) in the chamber 1560 of the disk 150. The centrifugal loads produce high fluid pressures (e.g., on the order of about $1.38\times10^7$ N/m$^2$) at the surface 1568 in the chamber 1560. The high fluid pressure increases the boiling temperature of the fluid 1564 which allows the fluid to absorb more thermal energy before it boils and generates the vapor 1576. In this manner, the coolant system 1508 more efficiently cools the disk 1500.

Figure 16A:
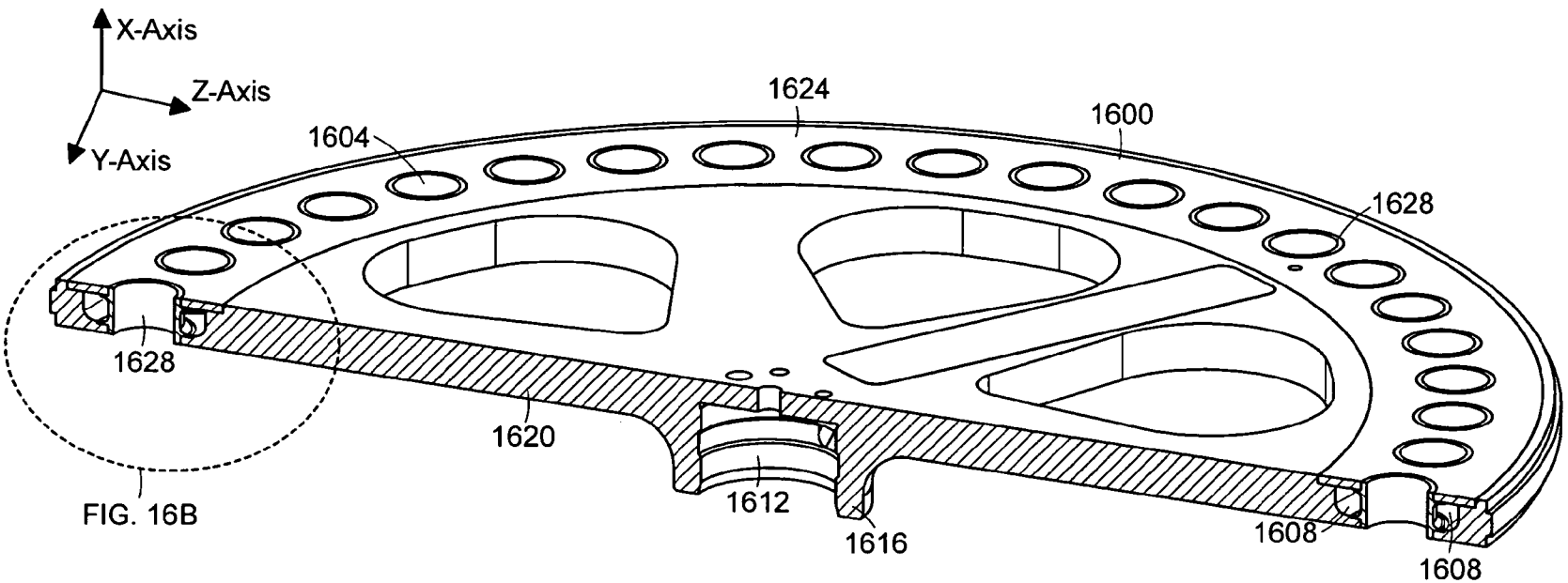
FIG. 16A is a cross-sectional perspective view of a rotating disk, according to an illustrative embodiment of the invention.
Figure 16B:
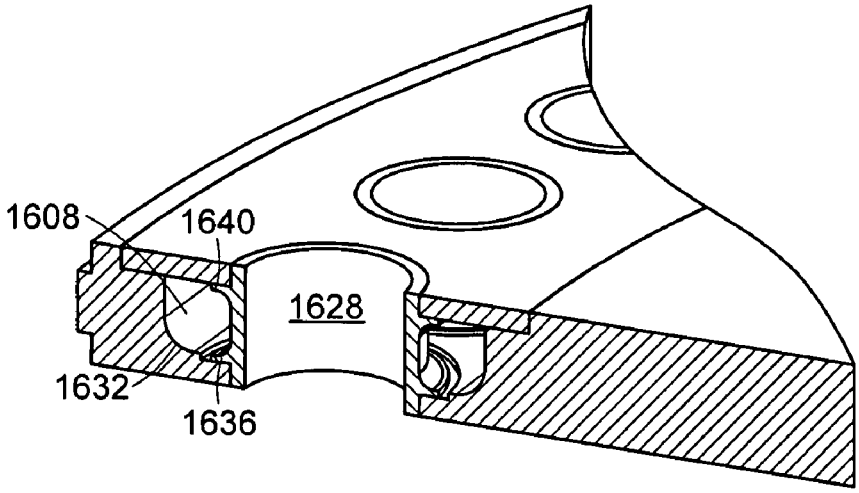
FIG. 16B is a more detailed view of a portion of the disk of FIG. 16A.

FIGS. 16A and 16B are cross-sectional perspective views of a rotating disk 1600, according to an illustrative embodiment of the invention. The rotating disk 1600 can be used in a plasma source, for example, the plasma source 100 of FIGS. 3A and 3B and other plasma sources. The rotating disk 1600 can be used in place of the disk 300 of the plasma source 100 of FIG. 3A. The rotating disk 1600 creates a localized high intensity zone in plasma loops, for example, the localized high intensity zone 144 of FIG. 3A.

The disk 1600 has a plurality of apertures 1604 that are located around the disk 1600 when viewed in the Y-Z plane. The disk 1600 can be rotated around the X-axis such that the channel 132 of FIG. 3A may alternately be uncovered when aligned with an aperture 1604 of FIG. 16A and covered when not aligned with an aperture 1604. The disk 1600 is configured to pinch plasma loops (i.e., decrease the cross-sectional area of plasma loops) in the apertures 1604, similarly as described herein.

The disk 1600 is partially hollow to accommodate flow of a coolant through channels 1608 in the disk 1600 to cool the disk 1600. Coolant is supplied to the channels 1608 of the disk 1600 via an opening 1612 in the disk 1600. A rotating shaft can be attached to the disk 1600 at a hub 1616 that defines the opening 1612 of the disk 1600.

The channels 1608 are defined by a circular bottom plate 1620, a circular top plate 1624 and a plurality of sleeves 1628. The sleeves 1628 are located in a recess in the bottom plate 1620. The top plate 1624 sandwiches the sleeves 1628 between the top plate 1624 and the bottom plate 1620. Referring to FIG. 16B, the sleeves 1628 have bottom flanges 1636 and top flanges 1640. The top plate 1624 abuts the top flanges 1640 of the sleeves 1628. The recess 1632 of the bottom plate 1620 abuts the bottom flanges 1636 of the sleeves 1628. In this manner, the sleeves 1628 are sandwiched between the bottom plate 1620 and the top plate 1624.

Generally, the bottom plate 1620, top plate 1624 and the sleeves 1628 are formed of materials (e.g., titanium, silicon carbide and boron nitride) that have good thermal shock resistance, a low thermal coefficient of expansion and have high thermal conductivity properties. In one embodiment, the bottom plate 1620 and the top plate 1624 are formed from titanium and the sleeves 1628 are formed from boron nitride. The top plate 1624 and the bottom plate 1620 are brazed (e.g., vacuum furnace brazed) or otherwise suitably joined together with the sleeves sandwiched between the top plate 1624 and the bottom plate 1620. In some embodiments, the sleeves are removable and/or replaceable.

In some embodiments, the sleeves 1628 include features that allow the disk 1600 to be firmly assembled (e.g., by bolting the components together) while maintaining adequate gaps around locations that are subsequently brazed. Features that can allow the disk to be firmly assembled include, for example, steps, ridges or recesses. In one embodiment, steps are disposed on the outer surface of the sleeve 1628 (e.g., in the location of the flanges 1636 and 164) to align and locate the top plate 1624 and bottom plate 1620 relative to each other and to the sleeves 1628 while maintaining a gap between the components for the brazing material to flow to adequately secure the components together. In one embodiment, gaps of about 0.025 mm-0.051 mm (0.001"-0.002") are used. In some embodiments, shims are used to create gaps sufficient for the brazing material to flow.

Alternative configurations of the components (e.g., top plate, bottom plate and inserts) of the disk 1600 can be used in alternative embodiments of the invention. For example, in one embodiment, the sleeves 1628 have a different number of flanges (zero, one or more than two). Further, in some embodiments, some or all of the components of the disk 1600 are brazed together. In some embodiments, the components are joined together by being press fit or shrink fit together.

In some embodiments, the disk 1600 is machined after the top plate 1624, bottom plate 1620 and the sleeves 1628 are joined together, to achieve final tolerances and/or to balance the disk 1600 for operation. The disk 1600 can be machined by, for example, drilling holes or milling a portion of the disk 1600 (e.g., top plate 1624 or bottom plate 1620). In some embodiments, the outer edge of the disk 1600 has a sacrificial ring. Portions of the sacrificial ring are selectively ground down to balance the disk 1600. In some embodiments, a volume of coolant (e.g., water) is placed in the disk 1600 during balancing of the disk 1600. In some embodiments, coolant is flowed through the disk 1600 during balancing of the disk 1600.

Figure 16C:
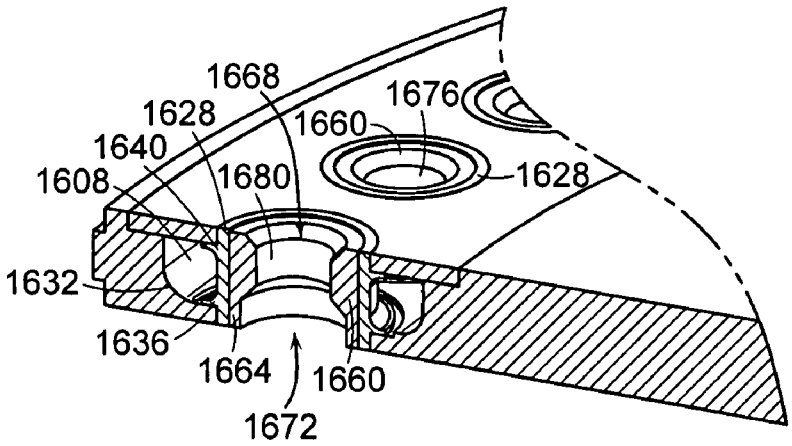
FIG. 16C is a detailed view of the portion of the disk of FIG. 16B incorporating an insert, according to an illustrative embodiment of the invention.

FIG. 16C is a cross-sectional perspective view of a portion of the rotating disk 1600 of FIGS. 16A and 16B that includes an insert 1660 (similarly as described herein), according to an illustrative embodiment of the invention. The insert 1660 has a body 1664 that has a first open end 1668 and a second open end 1672. Plasma loops enter the first open end 1668, pass through an interior passage 1676 of the insert 1660, and exit the second open end 1672. The interior passage 1676 of the insert 1660 defines a necked region 1680. The necked region 1680 is the region that defines a reduced dimension of the interior passage 1676 along the length of the passage 1676 of the insert 1660. The energy intensity is increased in the plasma loops in the necked region 1680 forming a localized high intensity zone.

In this embodiment, the insert 1660 is shrink fit into an interior passage defined by the sleeve 1628. In one embodiment, the insert 1660 is cooled and the disk 1600 is heated (e.g., various components of the disk 1600, for example, the insert 1628). The insert 1660 is then placed through the sleeve 1628. The disk 1600 is allowed to cool and the insert is allowed to warm up thereby creating a shrink fit between the insert 1660 and the sleeve 1628. In some embodiments, alternative structures, components and methods (similarly as described herein) are used to locate and fix the insert 1660 in the interior passage defined by the sleeve 1628.

The insert 1660 can be removed and replaced with a new insert 1660. The insert 1660 can be cooled (and/or the sleeve can be heated) to enable the insert 1660 to be removed from the sleeve 1628. A new insert 1660 can be installed similarly as previously described.

In some embodiments, the disk (e.g., the disk 1600 of FIGS. 16A, 16B and 16C or the disk 308 of FIGS. 3A and 3B) does not rotate. Sleeves and inserts can be used in these embodiments of the invention. The inserts can be installed by shrink fitting and subsequently removed similarly as described herein.

Figure 17B:
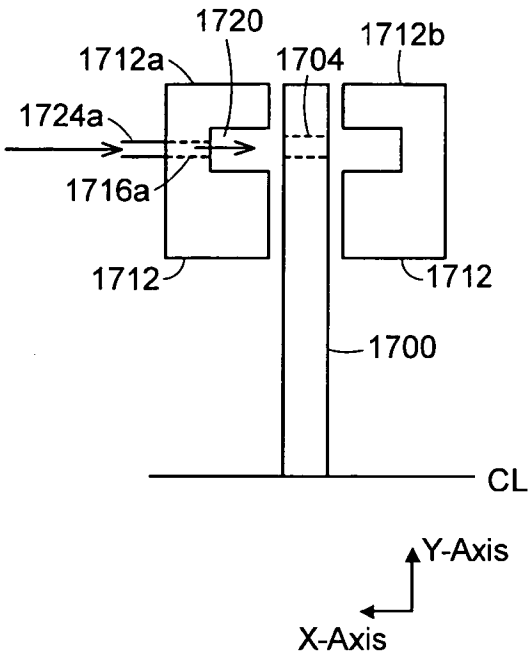
FIG. 17B is a partial cross-sectional view of the rotating disk of FIG. 17A.
Figure 17A:
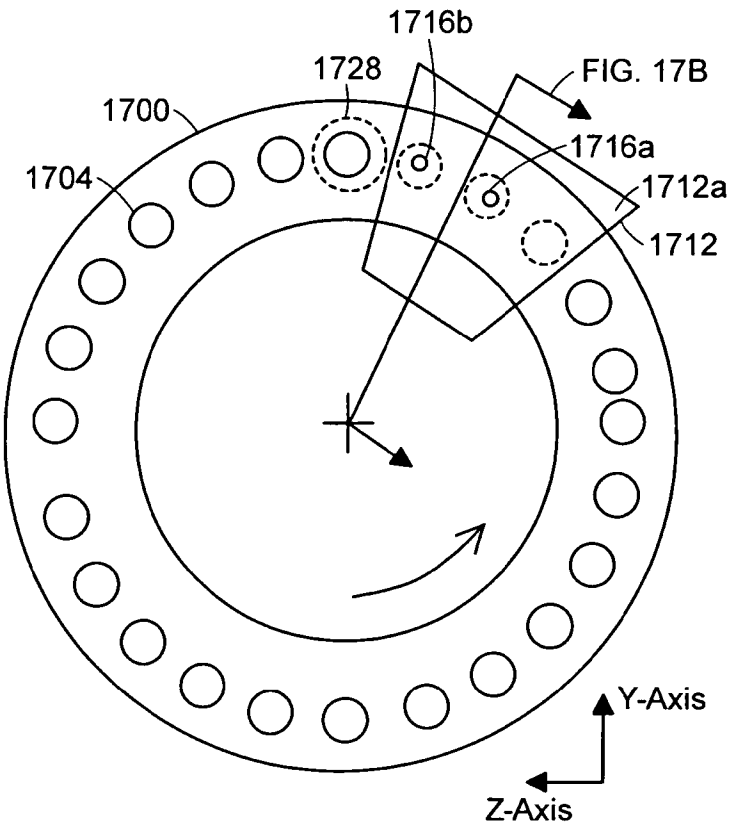
FIG. 17A is a schematic illustration of a rotating disk, according to an illustrative embodiment of the invention.

FIGS. 17A and 17*b* are schematic views of a rotating disk 1700, according to an illustrative embodiment of the invention. The disk 1700 rotates around the X-axis of FIG. 17A, similarly as described herein with respect to, for example, FIG. 14A. A cover structure 1712 (combination of a first section 1712*a* and a second section 1712*b*) covers three apertures 1704 in the disk 1700. The first section 1712*a* of the cover structure 1700 has two conduits 1716*a* and 1716*b*. In this embodiment, conduit 1716*a* is an inlet for introducing an ionizable medium to the structure 1712. An ionizable medium (e.g., solid, liquid or gas selected from the group consisting of Xenon, Lithium, Tin, Nitrogen, Argon, Helium, Fluorine, Ammonia, Stannane, Krypton and Neon) is provided to the port 1716*a* via a conduit 1724 coupled to the conduit 1716*a*. The ionizable medium passes through the conduit 1716*a* and into a chamber 1720 defined by the structure 1712. The ionizable medium passes into an aperture 1704 located adjacent the conduit 1716*a* and the chamber 1720.

The disk 1700 rotates around the X-axis and moves to a location where conduit 1716*b* is located in the cover structure 1712. A conduit (not shown) is coupled to the conduit 1716*b*. The conduit is coupled to a measurement device (not shown), for example, a pressure measurement device. By way of example, if the ionizable medium is an ionizable gas, the pressure of the ionizable gas located in the aperture 1704 that has moved to the location of the conduit 1716*b* of the cover structure 1712 can be measured prior to further rotation of the disk 1700 to a plasma discharge region of the plasma source where energy is delivered to the plasma. The disk 1700 continues to rotate such that the aperture 1704 next moves to a location 1728. A controller (e.g., computer processor) then provides a command signal to a power supply to send a pulse of energy to the magnetic core to deliver power to the plasma, similarly as described with respect to, for example, FIGS. 1 and 2.

In some embodiments, the ionizable medium is a liquid introduced as droplets via the conduit 1716*a* through the chamber 1720 and into an aperture 1704. In some embodiments, the ionizable medium is a solid (e.g., particles or a filament) that is introduced through the conduit 1716*a* into the chamber 1720. The ionizable medium then passes into an adjacent aperture 1704 of the disk 1700. In some embodiments, the ionizable medium is evaporated or sputtered onto an inner surface of the aperture 1704. In some embodiments, a cryogenically cooled source delivers the ionizable medium to the conduit 1716*a* of the structure 1712.

Figure 18:
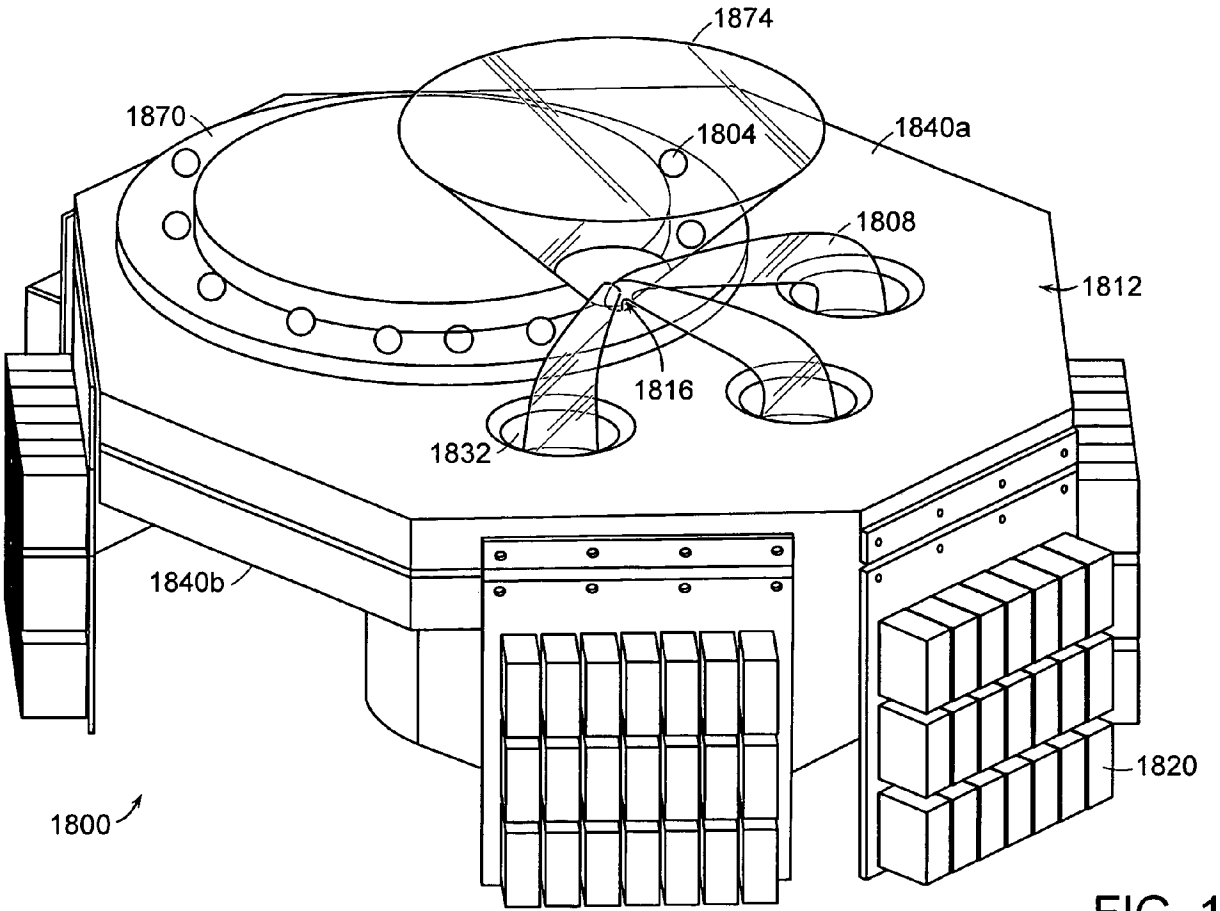
FIG. 18 is a schematic view of a source incorporating a rotating disk, according to an illustrative embodiment of the invention.

In another embodiment, illustrated in FIG. 18, a portion of a plasma source 1800 includes an enclosure 1812 that, at least, partially encloses a first magnetic core and a second magnetic core (for example, the first magnetic core 524 and second magnetic core 528 of FIG. 5B). In this embodiment, the enclosure 1812 has a first conductive plate 1840*a* that is disposed adjacent a second conductive plate 1840*b* that form a conductive path at least partially around the first magnetic core and form a primary winding around the first magnetic core of a transformer, similarly as described herein. The plates 1840*a* and 1840*b* also form a conductive path at least partially around the second magnetic core forming an inductor, such as the inductor 328 of FIG. 4. The plasma source 1800 also includes a plurality of capacitors 1820 located around the outer circumference of the enclosure 1812. By way of example, the capacitors 1820 can be the capacitor 320 of FIG. 4.

The enclosure 1812 defines at least two holes 1816 and 1832 that pass through the enclosure 1812. In this embodiment, there are three holes 1832 that are located a distance away from the hole 1816. Hole 1816 is a single hole through the enclosure 1812. In one embodiment, three plasma loops 1808 each converge and pass through the hole 1816 as a single current carrying plasma path. The three plasma loops 1808 also each pass through one of the three holes 1832. The parallel plates 1840*a* and 1840*b* have a groove (not shown), similarly as described, for example, with respect to grooves 504 and 506 of FIG. 5A. The grooves each locate an annular element (not shown) for creating a pressurized seal and for defining a chamber, such as the chamber 104 of FIG. 3A, which encloses the plasma loops 1808 during operation of the plasma source 1800.

The plasma source 1800 also includes a rotating disk 1870. In one embodiment, the rotating disk 1870 is the rotating disk 1400 of FIGS. 14A and 14B. The rotating disk has a plurality of apertures 1804 that pinch the plasma loops 1808 (i.e., decrease the cross-sectional area of the plasma loops 1880) in the apertures 1804 to create a localized high intensity zone in plasma loops 1880, for example, the localized high intensity zone 144 of FIG. 3A. The localized high intensity zone substantially localizes an emission of light that projects 1874 from the plasma source 1800. In alternative embodiments, the rotating disk 1870 is instead, for example, the rotating disk 1500 of FIG. 15 or the rotating disk 1600 of FIG. 16.

The disk 1870 can be rotated to locate one of the plurality of apertures 1804 over the hole 1816 to create the localized high intensity zone. The rotation of the disk 1870 can sequentially locate another of the plurality of apertures 1804 in the region of the hole 1816 of the plasma source 1800 to create the localized high intensity zone. In some embodiments, a pulse of energy is provided to a magnetic core of the plasma source 1800 when the one of the plurality of apertures 1804 is located over the hole 1816 of the plasma source 1800, similarly as described previously herein. The rotation of the disk 1870 can be synchronized with pulse rate of a pulse power system to locate at least one of the apertures 1804 in the region of the light source when a pulse of energy is provided to the plasma loops.

In some embodiments, the source 1800 includes a stationary cover (not shown) that covers the disk 1870. The stationary cover defines openings that allow the plasma loops 1808 to pass through the stationary cover while an ionizable gas is located within the stationary cover.

Figure 19:
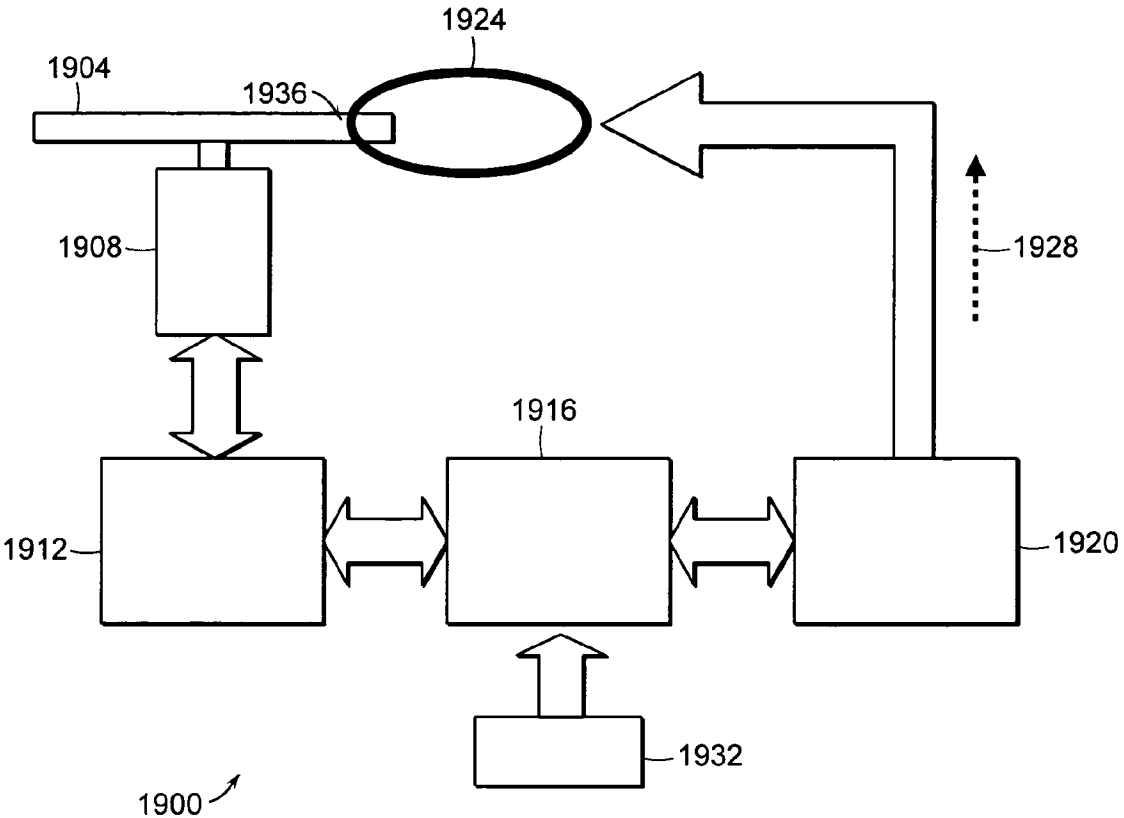
FIG. 19 is a schematic block diagram of a plasma source, according to an illustrative embodiment of the invention.

FIG. 19 is a block diagram of portion of a plasma source 1900, according to an illustrative embodiment of the invention. The plasma source 1900 includes a power source 1920 and a rotating disk 1904. The disk is, for example, the disk 1600 of FIGS. 16A and 16B. The disk 1904 creates a localized high intensity zone 1936 in one or more plasma loops 1924. Energy (e.g., pulses of energy) is provided to the plasma loops 1924 by the power source 1920, for example, as described herein. The source 1920 also includes a motor drive 1908 that is coupled to the disk 1904 to operate (e.g., rotate) the disk 1904.

The motor drive 1908 includes an encoder that measures the rotational position, speed and/or acceleration of the disk 1904. The source 1900 also includes a motor controller 1912 coupled to the motor drive 1908. The motor controller 1912 controls the motor drive 1908 and receives signals (e.g., position signals) from the encoder. The source also includes a system controller 1916. The system controller 1916 is coupled to both the motor controller 1912 and the power source 1920. Command signals (or sensor or feedback signals) can be exchanged or transmitted between the motor controller 1912 and the system controller 1916. Command signals (or sensor or feedback signals) can also be exchanged or transmitted between the power source 1920 and the system controller 1916.

In some embodiments, an external clock 1932 provides a signal to the system controller 1916. The system controller 1916 then provides appropriate signals to the motor controller 1912 and the power source 1920 to synchronize the position of the motor drive 1908 (i.e., the position of the disk 1904) with pulses of energy 1928 provided by the power source 1920 to the plasma loop 1924. In some embodiments, no external clock exists and, instead, the system controller 1916 synchronizes the rotation of the disk 1904 with the pulses of energy 1928 provided by the power source 1920 to the plasma loops 1924 based on a signal provided by the position encode to the system controller 1916.

Figure 20A:
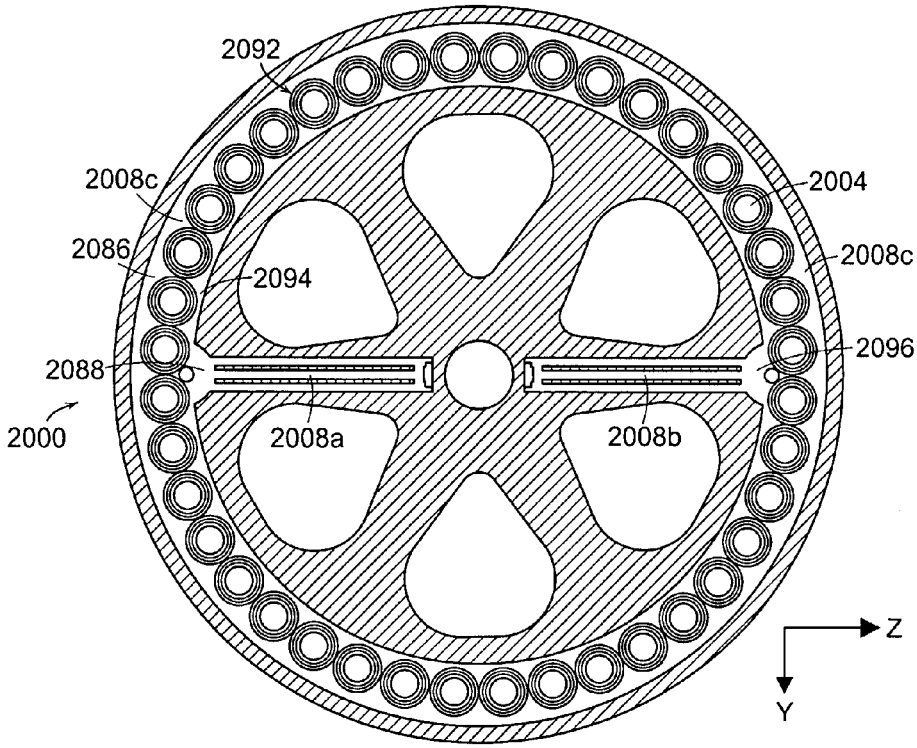
FIG. 20A is a cross-sectional view of a rotating disk, according to an illustrative embodiment of the invention.
Figure 20B:
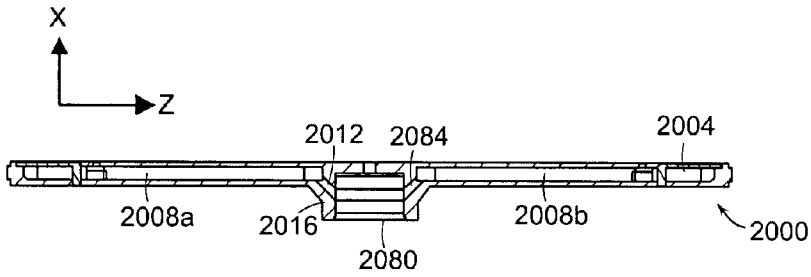
FIG. 20B is a rotated cross-sectional view of the rotating disk of FIG. 20A.

FIGS. 20A and 20B are cross-sectional views of a rotating disk 2000, according to an illustrative embodiment of the invention. The rotating disk 2000 can be used in a plasma source, for example, the plasma source 100 of FIGS. 3A and 3B or other plasma sources. The disk 2000 has a plurality of apertures 2004 that are located around the disk 2000 when viewed in the Y-Z plane. The disk can be rotated around the X-Axis similarly as described herein.

The disk 2000 is partially hollow to accommodate the flow of a coolant through the disk 2000. The disk has channels 2008*a*, 2008*b* and 2008*c* (generally 2008) in fluid communication with each other. Coolant flows through the channels 2008 to cool the disk 2000. Coolant is supplied to the disk 2000 via an inlet 2012 in the disk 2000. Coolant exist the disk via an outlet 2084. A rotating shaft (not shown) can be attached to the disk 2000 at a hub 2016 that defines an opening 2080 in the disk 2000.

In operation, coolant flows through a passage in the rotating shaft and enters the inlet 2012. The coolant flows radially outward from the center of the disk 2000 along channel 2008*a* towards location 2088. The coolant separates and flows in both the clockwise direction (positive rotation around the X-Axis) and counterclockwise direction (negative rotation around the X-Axis) around the disk 2000 when the coolant arrives at location 2088. The coolant flows within the disk 2000 around the outer surfaces 2092 of the apertures 2004. The coolant flows around the disk 2000 to location 2096 where it recombines and flows out of the outlet 2084. The coolant exiting the outlet 2084 flows into a passage in the rotating shaft and is delivered to a heat exchanger where the coolant is cooled.

In some embodiments, additional features or structural elements are located in the channels 2008*c* to control the flow of the coolant to direct coolant along the back side 2086 and front side 2094 of the apertures 2004 to improve the cooling performance (e.g., improve the convective coefficient of the system).

Figure 21A:
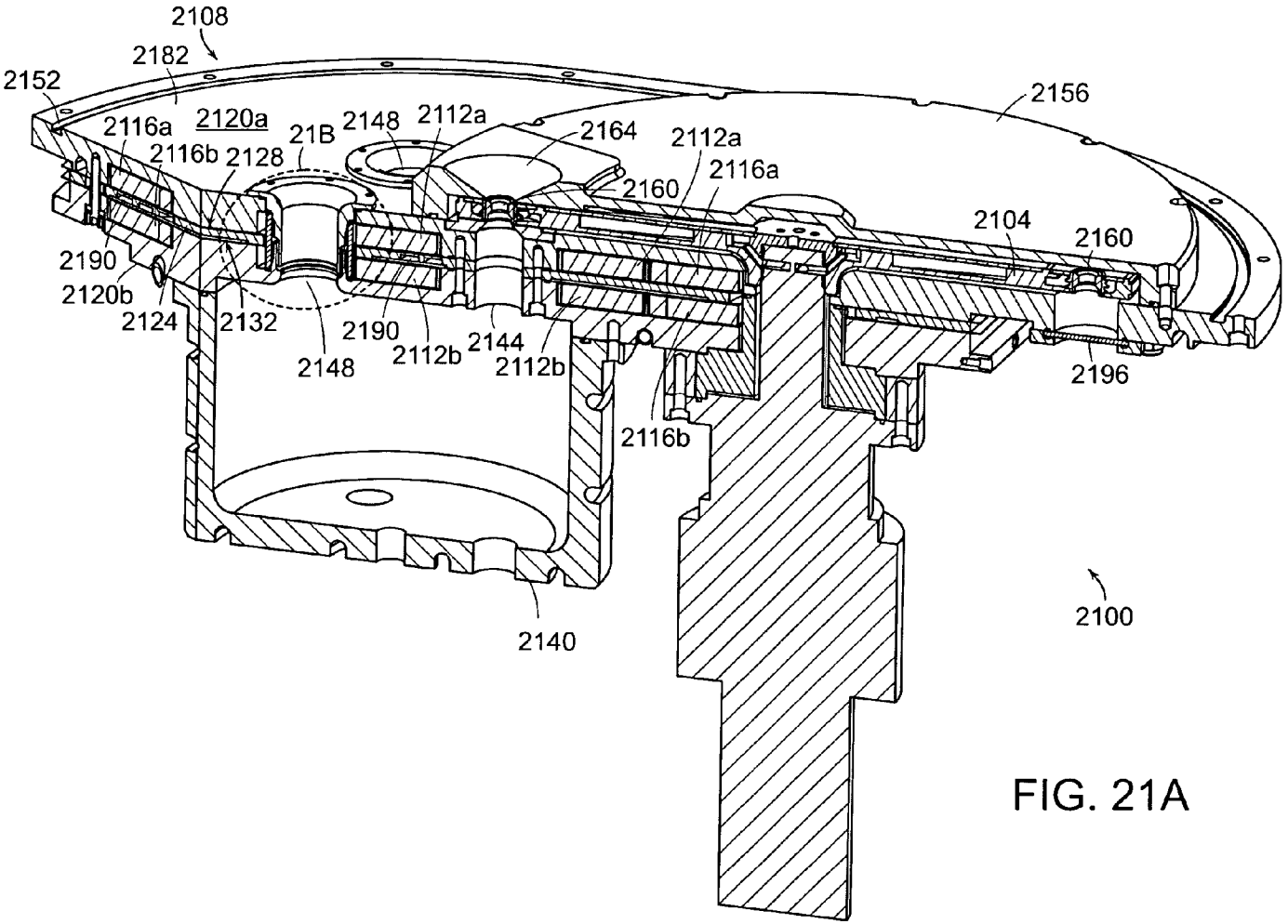
FIG. 21A is a schematic cross-sectional view of a source incorporating a rotating disk, according to an illustrative embodiment of the invention.
Figure 21B:
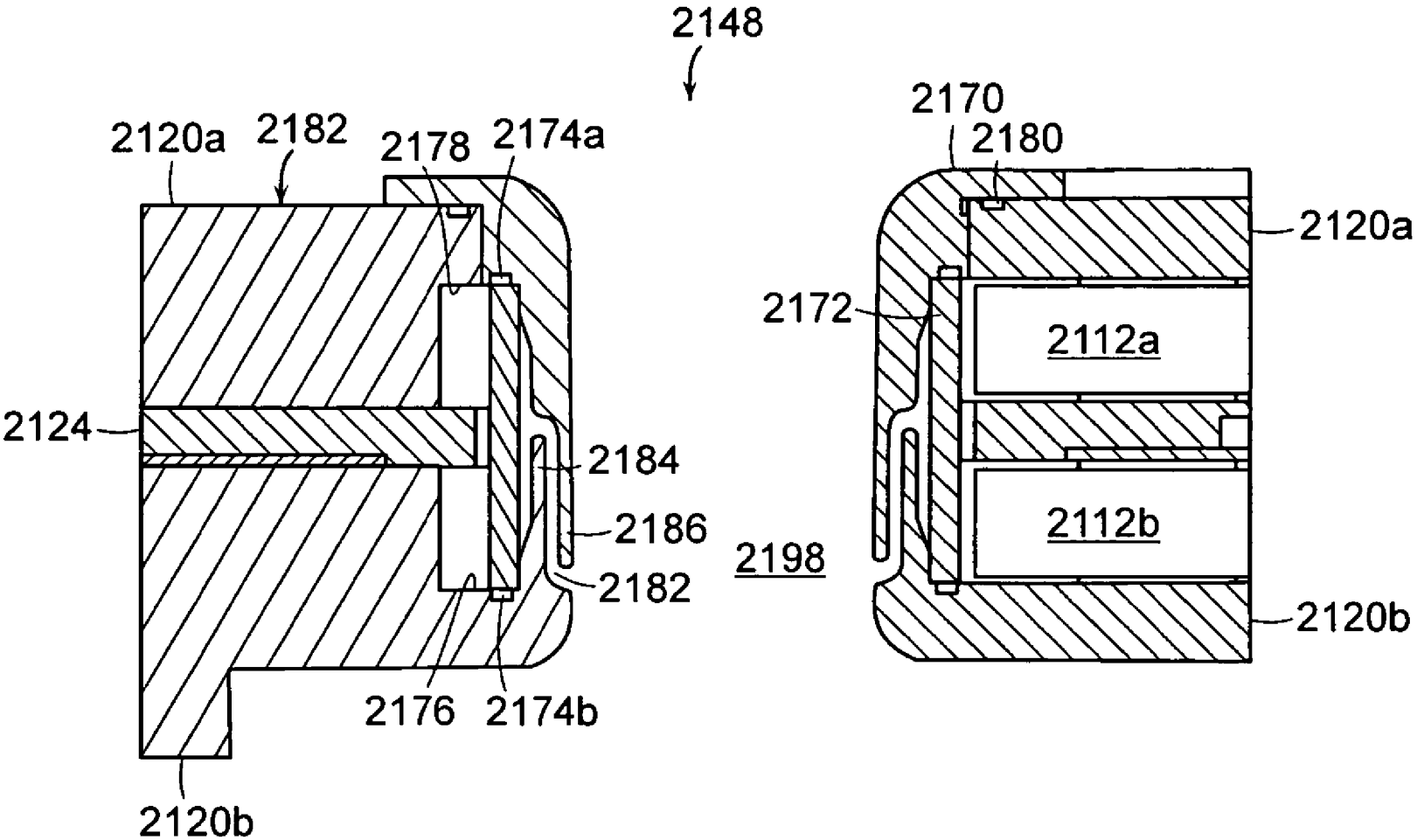
FIG. 21B is a detailed view of a portion of the source of FIG. 21A.

FIGS. 21A and 21B are schematic cross-sectional views of a source 2100 incorporating a rotating disk 2104, according to an illustrative embodiment of the invention. The source 2100 includes an enclosure 2108 that, at least partially, encloses a first set of magnetic cores 2112*a* and 2112*b* (collectively, the first magnetic core 2112). The enclosure 2108 also, at least partially, encloses a second set of magnetic cores 2116*a* and 2116*b* (collectively, the second set of magnetic cores 2116).

The enclosure 2108 has a first conductive plate 2120*a* and a second conductive plate 2120*b*. The first conductive plate 2120*a* and the second conductive plate 2120*b* are electrically coupled at the center of the plates and form a conductive path, at least partially, around the first magnetic core 2112 (combination of the magnetic cores 2112*a* and 2112*b*) and form a primary winding around the magnetic core 2112 of a transformer, similarly as described previously herein (e.g., with respect to FIG. 18). The first conductive plate 2120*a* and the second conductive plate 2120*b* also form a conductive path at least partially around the second set of magnetic cores 2116*a* and 2116*b* form an inductor, similarly as described herein regarding FIGS. 5A and 5B. In this manner, the combination of the second set of magnetic cores 2116*a* and 2116*b* and the conductive path created by the first and second conductive plates 2120*a* and 2120*b* are part of a power system and form a saturable inductor that delivers pulses of energy to the first set of magnetic cores 2112*a* and 2112*b*.

The enclosure also includes a third, intermediate plate 2124. The third plate 2124 is located between the cores 2112*a*/2116*a* and 2112*b*/2116*b*. The first conductive plate 2120*a* and a top surface 2128 of the third plate at least partially enclose the cores 2112*a* and 2116*a*. The second conductive plate 2120*b* and a bottom surface 2132 of the third plate 2124 at least partially enclose the cores 2112*b* and 2116*b*. Splitting the first magnetic core 2112 into magnetic core 2112*a* and magnetic core 2112*b* allows for more efficient cooling of the magnetic core material because the top and bottom of each core can be cooled. In this embodiment, cooling channels 2190 disposed in the third plate 2124 provide coolant to the third plate to cool the magnetic cores. Similarly, splitting the magnetic core 2116*a* and magnetic core 2116*b* allows for more efficient cooling because the top and bottom of each core can be cooled.

The enclosure 2108 also defines at least two holes 2144 and 2148 that pass through the enclosure 2108. In this embodiment, there are three holes 2148 (only two of the holes are shown for clarity of illustration purposes). Hole 2144 is a single hole through the enclosure 2108. Three plasma loops (not shown) each converge through the hole 2144 as a single current carrying plasma path. The three plasma loops each pass through one of the three holes 2148.

The first conductive plate 2120*a* has a groove 2152. The groove 2152 locates an annular element (not shown). The source 2100 also includes an enclosure 2140 that interfaces with the bottom side of the second conductive plate 2120*b*. The enclosure 2140 in combination with the annular element located in the groove 2152 creates a pressurized seal and defines a chamber, such as the chamber 104 of FIG. 3A which encloses the three plasma loops during operation of the source 2100.

The source 2100 also includes a rotating disk 2104. The rotating disk 2104 has a cover structure 2156 that covers a plurality of apertures 2160 in the disk 2104. The apertures 2160 rotate and sequentially align with an opening 2164 in the cover 2156 as the disk 2104 rotates. In some embodiments, a pulse of energy is provided to the first set of magnetic cores 2112 and 2112*b* such that when one of the plurality of apertures 2160 is aligned with the hole and the opening 2164 in the cover 2156, energy is provided to the plasma loops passing through the holes 2144 and 2148, similarly as described herein. In this embodiment, the source 2100 includes an optional window 2196 that is used to view the apertures 2160 during rotation to, for example, determine if the rotation of the rotating disk 2104 is proper.

FIG. 21B is a schematic cross-sectional view of a portion of the source 2100 of FIG. 21A. The source 2100 also includes a plurality of sleeves 2170. The sleeves 2170, in combination with the first conductive plate 2120*a* and the second conductive plate 2120*b* define the openings 2148. The source 2100 also includes a dielectric element 2172. In this embodiment, the dielectric element 2172 is a ceramic tube that is replaceable.

The source 2100 also includes a first o-ring 2174*a* and a second o-ring 2174*b*. The first o-ring 2174*a* provides a vacuum seal between and inner surface 2178 of the sleeve 2170 and the top (as viewed in FIG. 21B) of the dielectric element 2170. The second o-ring 2174*b* provides a vacuum seal between an inner surface 2176 of the second conductive plate 2120*b* and the bottom (as viewed in FIG. 21B) of the dielectric element 2170. In this embodiment, an additional o-ring 2180 provides a vacuum seal between the inner surface 2178 of the sleeve 2170 and a top surface 2182 of the first conductive plate 2120*a*. Screws are used to mechanically fasten the sleeve 2170 to the top surface 2182 of the first conductive plate 2120*a*.

When assembled, a gap 2182 is established between an extended portion or lip 2184 of the second conductive plate 2120*b* and a bottom portion or lip of the sleeve 2170. In this embodiment, the gap 2182 is approximately 1.52 mm (0.060") and provides sufficient electrical isolation between the sleeve 2170 which is attached to the first conductive plate 2120*a* and the second conductive plate 2120*b*. In this embodiment, the lip 2186 partially overlaps the lip 2184 creating a meandering path from the location of the dielectric element 2172 to a region 2198 within the opening 2148. This meandering path helps, for example, to minimize excited particles and gases from passing from the region 2198 to the dielectric element 2172 during operation of the source 2100.

Variations, modifications, and other implementations of what is described herein will occur to those of ordinary skill in the art without departing from the spirit and the scope of the invention as claimed. Accordingly, the invention is to be defined not by the preceding illustrative description but instead by the spirit and scope of the following claims.

What is claimed is:

1. A light source comprising:

a chamber having a plasma discharge region and containing an ionizable medium;

a magnetic core that surrounds a portion of the plasma discharge region;

a pulse power system for providing at least one pulse of energy to the magnetic core for delivering power to a plasma formed in the plasma discharge region that forms a circuit of a transformer; and a disk having a plurality of apertures confining a localized high intensity zone of the plasma, wherein the disk is rotatable to locate one of the plurality of apertures in a region of the light source to create the localized high intensity zone.

2. The light source of claim 1 wherein the apertures are configured to substantially localize an emission of light by the localized high intensity zone of the plasma.

3. The light source of claim 1 wherein the disk comprises cooling capability.

4. The light source of claim 1 wherein rotation of the disk sequentially locates another of the plurality of apertures in the region of the light source to create the localized high intensity zone.

5. The light source of claim 4 comprising a gas conduit.

6. The light source of claim 5 wherein the disk comprises the gas conduit.

7. The light source of claim 6 wherein the ionizable medium is provided to the aperture via the gas conduit.

8. The light source of claim 7 wherein the ionizable medium is provided to the aperture prior to locating the aperture in the region.

9. The light source of claim 8 comprising a pressure measurement device.

10. The light source of claim 9 wherein the pressure measurement device measures pressure of the ionizable medium in the aperture prior to locating the aperture in the region.

11. The light source of claim 4 comprising at least one conduit in communication with at least one aperture for a period of time during the rotation of the disk.

12. The light source of claim 11 wherein the at least one conduit is an inlet or pressure measurement conduit.

13. The light source of claim 1 wherein the pulse of energy is provided to the magnetic core when the one of the plurality of apertures is located in the region of the light source.

14. The light source of claim 1 wherein rotation of the disk is synchronized with pulse rate of the pulse power system to locate at least one of the apertures in the region of the light source.

15. The light source of claim 1 comprising a rotary drive coupled to the disk.

16. The light source of claim 15 wherein the rotary drive is supplied by a tool or piece of equipment comprising the light source.

17. The light source of claim 1 wherein the ionizable medium is a solid, liquid or gas.

18. The light source of claim 1 wherein the ionizable medium is at least one or more solid, liquid or gas selected from the group consisting of Xenon, Lithium, Tin, Nitrogen, Argon, Helium, Fluorine, Ammonia, Stannane, Krypton and Neon.

19. The light source of claim 1 comprising an insert located in the aperture.

20. The light source of claim 19 wherein the insert is shrink fit into the aperture.

21. The light source of claim 19, wherein at least one interior passage of the insert defines a region to create the localized high intensity zone in the plasma.

22. The light source of claim 19, wherein the insert is a consumable element.

23. The light source of claim 19 wherein the insert comprises a silicon carbide material.

24. The light source of claim 19 wherein the ionizable medium is provided to the interior passage of the insert via the gas inlet.

25. The light source of claim 1 comprising a rotating shaft coupled to the disk.

26. The light source of claim 25 wherein coolant is provided to an interior region of the disk via the shaft.

27. The light source of claim 26 wherein coolant in the interior region of the disk cools the disk based on a heat-pipe principle.

28. The light source of claim 26 wherein coolant is pumped through the interior region of the disk.

29. The light source of claim 28 wherein the coolant cools the plurality of apertures.

30. A method for generating a light signal comprising:

introducing an ionizable medium capable of generating a plasma into a chamber;

applying at least one pulse of energy to a magnetic core that surrounds a portion of a plasma discharge region within the chamber such that the magnetic core delivers power to the plasma that forms a circuit of a transformer;

confining a localized high intensity zone of the plasma with a plurality of apertures of a disk; and rotating the disk to locate one of the plurality of apertures in a region of the light source to create the localized high intensity zone.

31. The method of claim 30 wherein the apertures are configured to substantially localize an emission of light by the plasma.

32. The method of claim 30 comprising rotating the disk to sequentially locate another of the plurality of apertures in the region of the plasma to create the localized high intensity zone.

33. The method of claim 30 comprising applying the pulse of energy to the magnetic core when one of the plurality of apertures is located in the region of the plasma having the localized high intensity zone.

34. The method of claim 30 comprising synchronizing pulse rate of pulses of energy applied to the magnetic core with rotation of the disk.

35. The method of claim 30 comprising introducing the ionizable medium via a gas inlet.

36. The method of claim 30 comprising introducing the ionizable medium to the aperture via a gas inlet.

37. The method of claim 30 comprising introducing the ionizable medium to the aperture prior to locating the aperture in the region of the plasma having the localized high intensity zone.

38. The method of claim 37 measuring pressure of the ionizable medium in the aperture prior to locating the aperture in the region of the plasma having the localized high intensity zone.

39. The method of claim 30 comprising providing coolant to an interior region of the disk via a shaft coupled to the disk.

40. The method of claim 39 pumping the coolant through the interior region of the disk.

41. A light source comprising:

means for introducing an ionizable medium capable of generating a plasma into a chamber;

means for applying at least one pulse of energy to a magnetic core that surrounds a portion of a plasma discharge region within the chamber such that the magnetic core delivers power to the plasma that forms a circuit of a transformer;

means for confining a localized high intensity zone of the plasma with a plurality of apertures of a disk; and means for rotating the disk to locate one of the plurality of apertures in a region of the light source to create the localized high intensity zone.

* * * * *